US005921688A

United States Patent [19]

Furuya et al.

[11] Patent Number: 5,921,688

[45] Date of Patent: Jul. 13, 1999

[54] TAPE PRINTING APPARATUS

[75] Inventors: Yoshikiyo Furuya; Chie Ohshima, both of Nagano; Kenji Watanabe, Tokyo; Takanobu Kameda, Tokyo; Tomoyuki Shimmura, Tokyo; Chieko Aida, Tokyo, all of Japan

[73] Assignees: Seiko Epson Corporation; King Jim Co., Ltd., both of Tokyo, Japan

[21] Appl. No.: 08/833,218

[22] Filed: Apr. 14, 1997

[30] Foreign Application Priority Data

Apr. 15, 1996 [JP] Japan ..... 8-092895
Apr. 15, 1996 [JP] Japan ..... 8-092896

[51] Int. Cl.[6] ..... B41J 35/28

[52] U.S. Cl. ..... 400/207; 400/692; 400/613; 101/288

[58] Field of Search ..... 400/207, 208, 400/242, 613.1, 692, 246; 101/288; 347/108

[56] References Cited

U.S. PATENT DOCUMENTS

| | | | |
|---|---|---|---|
| 4,632,585 | 12/1986 | Oyamatsu et al. | 400/613 |
| 4,681,468 | 7/1987 | Kallin et al. | 400/692 |
| 4,754,290 | 6/1988 | Kitayama et al. | 400/207 |
| 5,333,959 | 8/1994 | Yamaguchi et al. | 400/208 |
| 5,370,469 | 12/1994 | Mutou et al. | 400/206 |
| 5,597,247 | 1/1997 | Inakoshi et al. | 400/207 |

FOREIGN PATENT DOCUMENTS 5185707 7/1993 Japan .

*Primary Examiner*—Christopher A. Bennett
*Attorney, Agent, or Firm*—Loeb & Loeb LLP

[57] ABSTRACT

A tape printing apparatus includes a body, and a lid arranged on the body in a hinged-door form, the body having a pocket formed therein for removably loading a cartridge containing a tape-like member as a printing object material. An ejecting mechanism elevates the cartridge when the cartridge is in a state loaded in the pocket. The cartridge is classified into at least a small-height cartridge containing a tape-like member having a small width and a large-height cartridge containing a tape-like member having a large width. The body has a first support member arranged in the pocket for receiving a seating portion of the small-height cartridge in a shallow position in the pocket and a second support member arranged in the pocket for receiving a seating portion of the large-height cartridge in a deep position in the pocket. The first support member is arranged in a position away from the seating portion of the large-height cartridge when the large-height cartridge is loaded in the pocket. The second support member is arranged in a position away from the seating portion of the small-height cartridge loaded when the small-height cartridge is loaded in the pocket.

19 Claims, 20 Drawing Sheets

TAPE PRINTING APPARATUS

BACKGROUND OF THE INVENTION

1. Field of the Invention

This invention relates to a tape printing apparatus having a body formed with a pocket for removably loading a cartridge containing a tape-like member as a printing object material, and more particularly to a tape printing apparatus of this kind which is capable of loading a various kinds of cartridges different in height.

2. Prior Art

A conventional tape printing apparatus of this kind has been proposed e.g. by Japanese Laid-Open Patent Publication (Kokai) No. 6-122239, which prints desired characters on a plain tape by the use of an ink ribbon, and cuts off a printed portion from the tape to form a label. The tape and the ink ribbon as consumable articles are contained in a cartridge as rolls around respective reels, and provided in this state for use in the apparatus. The apparatus has a pocket formed in a body thereof for removably loading the cartridge therein from above as well as drive shafts for feeding the tape and the ink ribbon and a print head for printing on the tape, which extend in the pocket.

The proposed tape printing apparatus uses five different kinds of tape and five different kinds of ink ribbon, which vary in width (6 mm, 9 mm, 12 mm, 18 mm, and 24 mm), and two kinds of cartridges different in height which accommodate corresponding kinds of tape and ink ribbon (one kind for tapes and ink ribbons having widths of 6 mm, 9 mm, and 12 mm, and the other kind for those having widths of 18 mm and 24 mm). Further, the apparatus is provided with a print head having an array of heating elements which corresponds in size to the ink ribbon having the maximum width so as to suit five kinds of ink ribbons (and tapes) which are different in width. Each of the two kinds of cartridges different in height is loaded in the same pocket such that it is seated on the bottom plate of the pocket. Therefore, to facilitate the removal of a cartridge even if it has a small height, deep grooves are formed on opposite inner walls of the pocket for the user to insert fingers therein in removing the cartridge having the small height.

Recently, a tape having an even larger width (e.g. 36 mm) is desired to be used for tape printing apparatuses of this kind. To use such a tape having a still larger width, a cartridge having a even larger height is necessary, and at the same time, the tape printing apparatus per se is required to have a larger height so as to form a deeper pocket therein. If the deeper pocket is provided, deeper grooves are necessarily required to be formed therefor so as to facilitate the removal of cartridges therefrom. As a matter of fact, the grooves are also required to have a larger width. Otherwise, the fingers cannot be properly inserted therein, so that without deeper and wider grooves, it is impossible for the user to take out a cartridge having a small height from such a even deeper pocket. Accordingly, the tape printing apparatus is required to have a larger width. The inconvenience of unnecessary increase in size for easy removal of cartridges can be avoided so long as the use of the cartridge having the smallest height is abolished, and tapes (as well as ink ribbons) having widths of 6 mm, 9 mm, and 12 mm are contained in a cartridge having a medium height. However, this makes it impossible to use small-height cartridges which are already available on the market.

Further, the print head employed in this kind of tape printing apparatus is arranged such that it is slightly urged toward the tape and ink ribbon mainly at a central portion thereof so as to cause the array of heating elements to be brought into contact with the ink ribbon in a uniform fashion. Therefore, if a narrow tape received within a small-height cartridge is fed to a print head suitable for a wide tape, the print head can contact the ink ribbon and tape at a location largely deviated from the center of the print head.

SUMMARY OF THE INVENTION

It is a first object of the invention to provide a tape printing apparatus which permits the loading of a small-height cartridge therein in an easily removable fashion.

It is a second object of the invention to provide a tape printing apparatus which is capable of using both a small-height cartridge and a large-height cartridge, without forming deeper grooves for facilitating the removal of cartridges.

To attain the first object, the invention provides tape printing apparatus including a body, and a lid arranged on the body in a hinged-door form, the body having a pocket formed therein for removably loading a cartridge containing a tape-like member as a printing object material.

The tape printing apparatus according to the first aspect of the invention is characterized by comprising an ejecting mechanism for elevating the cartridge when the cartridge is in a state loaded in the pocket.

According to this construction of the tape printing apparatus, the cartridge loaded in the pocket can be brought to an elevated position. Therefore, not only a large-height cartridge and a small-height cartridge can be easily taken out in the same manner. That is, irrespective of whether the tape cartridge is of a small-height type or a large-height type, it can be easily taken out in the same manner, thereby facilitating the handing of cartridges.

Preferably, the ejecting mechanism elevates the cartridge in a manner interlocked to an opening operation for opening the lid from a half-open position to a fully-open position.

According to this preferred embodiment, the ejecting mechanism elevates the cartridge in a manner interlocked to the operation of opening the lid from its half-open position to its fully-opening position. Therefore, when the lid is opened from the fully-closed position to the half-open position, the cartridge remains set in the pocket. From this state, if the lid is closed, the apparatus gains access to the cartridge and is ready for printing operation. On the other hand, if the lid is opened, the cartridge is elevated, to permit the same to be taken out of the pocket with ease. In other words, the present apparatus is capable of opening the lid to its half-open position with the cartridge remaining set in the pocket, and in the resulting state, the cartridge can be checked or ascertained by the eye. Therefore, the user can open the lid not only to take the cartridge out of the pocket but also to ascertain the cartridge by the eye, as desired in a quite distinguished or selective manner.

More preferably, the tape printing apparatus includes a spring member for causing the lid to be pivotally moved from a fully-closed position to the half-open position, and release operation means for holding the lid in a hooked state, and releasing the lid in the hooked state.

According to this preferred embodiment, the release operation means is capable of easily opening the lid from its fully-closed position to the half-open position, thereby facilitating the checking or ascertaining of the cartridge by the eye.

Preferably, the ejecting mechanism comprises a base plate arranged vertically movable for receiving the cartridge thereon, urging means for urging the base plate in an elevating direction, and plate-locking means for locking the base plate in a lowermost position and unlocking the base plate in a fashion interlocked to an opening operation of the lid.

According to this preferred embodiment, by lowering the base plate to its lowermost position, i.e. by pressing the cartridge positioned on the base plate deep into the pocket, the base plate can be locked, whereby the loading operation of the cartridge is entrusted to the user. This makes the user feel assured of the cartridge being reliably and securely loaded in the pocket. Further, the construction of the ejecting mechanism can be simplified. Similarly, the operation of opening the lid for taking the cartridge out of the pocket is also entrusted with the user, so that the user feels assured of the state of cartridge and operation thereof. Moreover, when the cartridge is taken out of the pocket, the base plate remains in an elevated position and hence another cartridge can be easily set thereon.

Further preferably, the pocket is capable of receiving both a large-height cartridge and a small-height cartridge, the base plate comprising a base plate body for receiving the large-height cartridge thereon, and projections extending upward from the base plate body for receiving the small-height cartridge thereon.

According to this preferred embodiment, while keeping the stroke of elevation of the base plate, both the large-height cartridge and the small-height cartridge can be elevated to respective positions in which each of them can be easily taken out of the pocket. Further, it is possible to bring or set the center of height of the small-height cartridge and that of height of the large-height cartridge to an identical and constant level.

Preferably, the lid has a hinge portion via which the lid is pivotally and detachably mounted on the body, the tape printing apparatus including closing obstruction means for obstructing a closing operation of the lid when the cartridge is in an elevated position in the pocket.

According to this preferred embodiment, when the user is not capable of closing the lid, he is made conscious that he should either take the cartridge out of the pocket or fully i.e. properly load the same in the pocket. Even if he attempts to forcibly close the lid without being conscious of such an incompletely set state of the cartridge, the lid is only detached from the body. Therefore, breakage of the lid and damage to the cartridge due to such an erroneous closing operation can be prevented in a fail-safe fashion.

Further preferably, the closing obstruction means has an obstruction member for being brought into a position for obstructing the closing operation of the lid in a manner interlocked to elevation of the cartridge in the pocket, the obstructing member being held in the position for obstructing the closing operation of the lid through abutment on the cartridge in the elevated position.

According to this preferred embodiment, when the cartridge is taken out of the pocket, the obstruction member is no longer capable of obstructing the closing of the lid, so that the lid can be closed without any inconvenience. That is, when the ejecting mechanism is in a state for receiving the cartridge, the lid can be fully closed, whereby the apparatus can be easily set to a wait state.

To attain the second object, according to a second aspect of the invention, there is provided a tape printing apparatus including a body, the body having a pocket formed therein for removably loading a cartridge containing a tape-like member for use in printing, the cartridge being classified into at least a small-height cartridge containing a tape-like member having a small width, the small-height cartridge having a seating portion, and a large-height cartridge containing a tape-like member having a large width, the large-height cartridge having a seating portion.

The tape printing apparatus according to the second aspect of the invention is characterized in that the body has first support means arranged in the pocket for receiving the seating portion of the small-height cartridge in a shallow position in the pocket and second support means arranged in the pocket for receiving the seating portion of the large-height cartridge in a deep position in the pocket;

the first support means being arranged in a position away from the seating portion of the large-height cartridge when the large-height cartridge is loaded in the pocket;

the second support means being arranged in a position away from the seating portion of the small-height cartridge when the small-height cartridge is loaded in the pocket.

According to this construction of the tape printing apparatus, the small-height cartridge is supported by the first support means in a shallow position within the pocket without interfering the second support means. In contrast, the large-height cartridge is supported by the second support means in a deep position within the pocket without interfering the first support means. This makes it possible to make the difference in position between the two kinds of cartridges in their loaded states, i.e. the difference in level between upper surfaces of the two kinds of cartridges in their loaded states, smaller than the difference between the heights of the two kinds of cartridges. Therefore, it is not required to insert fingers deep into the pocket when the small-height cartridge is to be taken out, thereby facilitating the removal of cartridges. Further, the difference in level between the first support means and the second support means enables a tape-like member contained in each cartridge to be set to a substantially identical position. In other words, cartridges of a small-height type and a large-height type can be employed, and the loading and removal of them can be easily carried out without forming deep grooves for removal operation. Further, the position of the tape-like member with respect to the body of the tape printing apparatus does not largely differ between the small-height type cartridge and the large-height type cartridge, so that printing on the tape-like member can be carried out properly without suffering from adverse effects resulting from the difference in the type of cartridges loaded in the apparatus.

Preferably, the cartridge has a tape reel, the tape-like member being contained within the cartridge in a state wound around the tape reel, the small-height cartridge having a first detent member for inhibiting the tape reel from rotation, and the large-height cartridge having a second detent member for inhibiting the tape reel from rotation, the body having a first release member for releasing the tape reel from the first detent member, and a second release member for releasing the tape reel from the second detent member, the first release member being capable of retracting from the pocket, the second release member being arranged at a location in which the second release member is away from the small-height cartridge when the small-height cartridge is loaded in the pocket, the large-height cartridge being formed with an urging portion for causing the first release member to be retracted from the pocket as the large-height cartridge is loaded in the pocket.

According to this preferred embodiment, when the small-height cartridge is loaded in the pocket in its shallow position, the first release member releases the tape reel from the first detent member. On the other hand, when the large-height cartridge is loaded in the pocket in its deep position, the second release member releases the tape reel from the second detent member. When the small-height cartridge is loaded, the second release member is away from the small-height cartridge, so that the second release member does not interfere with the loading of the small-height cartridge. On the other hand, When the large-height cartridge is loaded, the first release member is retracted from the pocket, so that the first release member does not interfere with the loading of the large-height cartridge. As a result, the tape reel is released from the detent member in a reliable manner irrespective of the kind of the cartridge.

Preferably, the tape printing apparatus includes a drive source, and the cartridge contains a rotating member for feeding the tape-like member, the rotating member having a shaft hole formed therein, the body having a drive shaft for being engaged in the shaft hole of the rotating member, the drive shaft having a drive shaft body for engagement with the shaft hole, the drive shaft body being connected to the drive source, a center pin for supporting the drive shaft body in a rotatable and axially movable fashion, and a spring for urging the drive shaft body toward the cartridge.

According to this preferred embodiment, the drive shaft body connected to the drive source is supported on the support pin in a rotatable and axially movable fashion, and in this state, urged toward the cartridge. Therefore, when the small-height cartridge is loaded in the pocket, the spring contracts slightly and the drive shaft body is displaced slightly to properly engage with rotating member of the small-height cartridge. On the other hand, when the large-height cartridge is loaded in the pocket, the spring largely contracts and the drive shaft body is displaced largely to properly engage with the rotating member of the small-height cartridge. Thus, the drive shaft is displaced in a loading direction against the urging force of the spring, which makes it possible to cause the rotating member of each cartridge to be securely engaged with the drive source side.

Preferably, the cartridge includes a tape reel around which the tape-like member is wound, and a detent member for restricting rotation of the tape reel, the body having a release projection which extends into the pocket for urging the detent member into a release position, the release projection having a first urging member for urging the detent member of the small-height cartridge and a second urging member for urging the detent member of the large-height cartridge, the first urging member being arranged at a location in which the first urging member is away from the detent member of the large-height cartridge when the large-height cartridge is loaded in the pocket, the second urging member being arranged at a location in which the second urging member is away from the detent member of the small-height cartridge when the small-height cartridge is loaded in the pocket.

According to this preferred embodiment, when the small-height cartridge is loaded in the pocket in a shallow position, the first urging member releases the tape reel from the detent member. Further, when the large-height cartridge is loaded in a deep position within the cartridge, the second urging member provided on the body releases the tape reel from the detent member. When the small-height cartridge is loaded, the second urging member is away from the detent member, so that the second urging member does not interfere with the loading of the small-height cartridge. On the other hand, when the large-height cartridge is loaded, the first urging member is away from the detent member, so that the first urging member does not interfere with the loading of the large-height cartridge. As a result, the inhibition of rotation of the tape reel by the detent member can be made ineffective in a reliable manner without adversely affecting the loading and removal of the cartridge.

The above and other objects, features, and advantages of the invention will become more apparent from the following detailed description taken in conjunction with the accompanying drawings.

DETAILED DESCRIPTION

The invention will now be described in detail with reference to the drawings showing a preferred embodiment thereof. A tape printing apparatus of the invention prints on a tape based on key entry made as desired, and is capable of cutting off a printed portion from the tape. The printed portion cut off from the tape is used e.g. for a label for being pasted on a document file or the like. That is, the tape printing apparatus makes a label printed with characters from a pain continuous tape. The plain continuous tape and an ink ribbon as consumable articles are contained in a cartridge, and fed to the printing apparatus from the cartridge.

Figure 1:
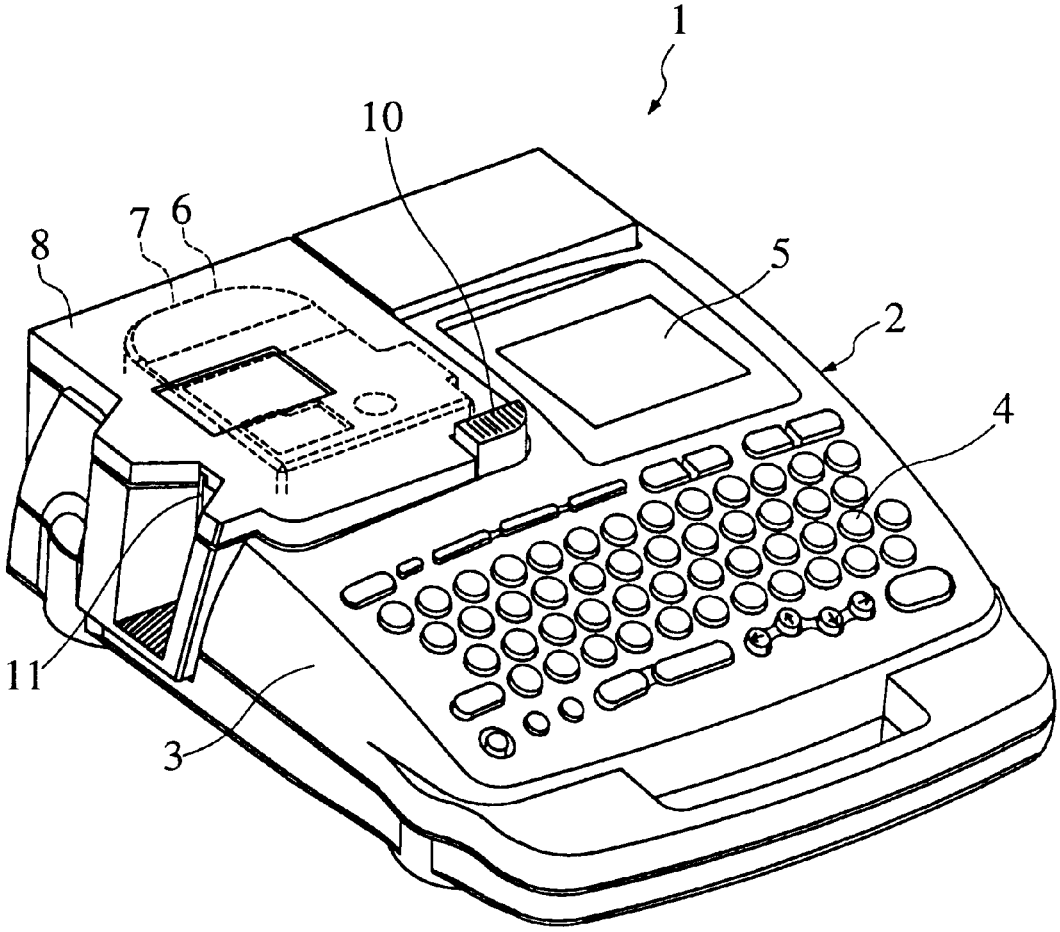
FIG. 1 is a perspective view showing an appearance of a tape printing apparatus according to an embodiment of the invention.

Referring first to FIG. 1, there is shown an appearance of a tape printing apparatus 1 according to an embodiment of the invention. The tape printing apparatus 1 has a body 2 comprised of a casing 3 divided into an upper portion and a lower portion, a key entry block 4 arranged at a front portion, a display 5 arranged at a right-hand rear portion, and a pocket 7 formed at a left-hand rear portion for loading a cartridge 6 therein. The pocket 7 is provided with a lid 8 having a window formed therein. The lid 8 is hinged to the body 2, as will be described hereinafter, for opening and closing the pocket 7. The pocket 7 incorporates an ejecting mechanism 9 (see FIG. 4), described hereinafter, which receives the cartridge 6 into the pocket 7 and causes the cartridge 6 to be elevated to a position from which it can be easily removed from the tape cartridge 6.

Figure 13:
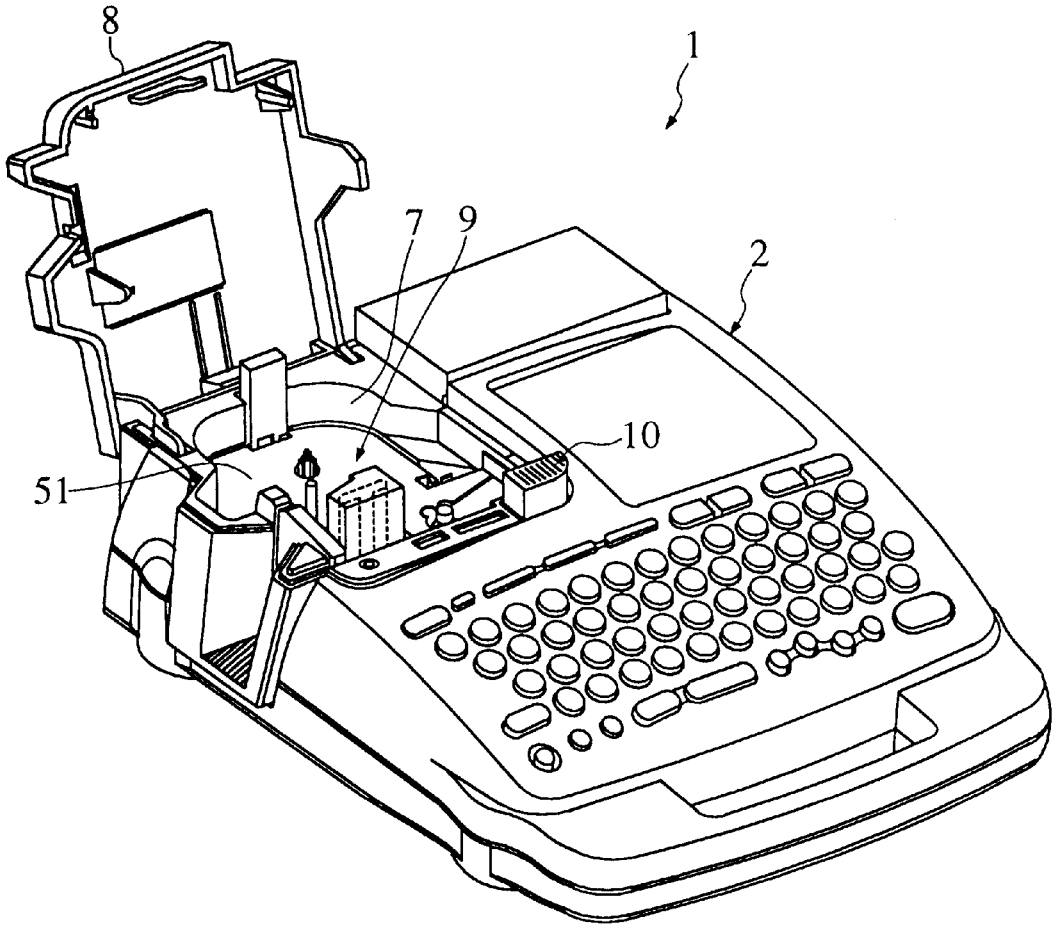
FIG. 13 is a perspective view of the tape printing apparatus with its lid open.

When the tape printing apparatus 1 is used for making a label, first, a release button 10 located on a corner of the lid 8 is depressed to let the lid 8 be sprung out to a half-open position, and then the lid 8 is manually operated to a fully-open position (see FIG. 13). Then, the cartridge 8 is placed or set in the pocket 7 from above, and then pressed therein to a fully-loaded or lowermost position. After the cartridge 6 is in the fully-loaded position, the lid 8 is closed, whereby the apparatus 1 is set on standby for printing. Then, the user operates the key entry block 4 while observing the display 5 to enter text as desired. When a properly-effected entry of the text is ascertained via the display 5, the key entry block 4 is further operated to give an instruction for a printing operation.

Figure 14:
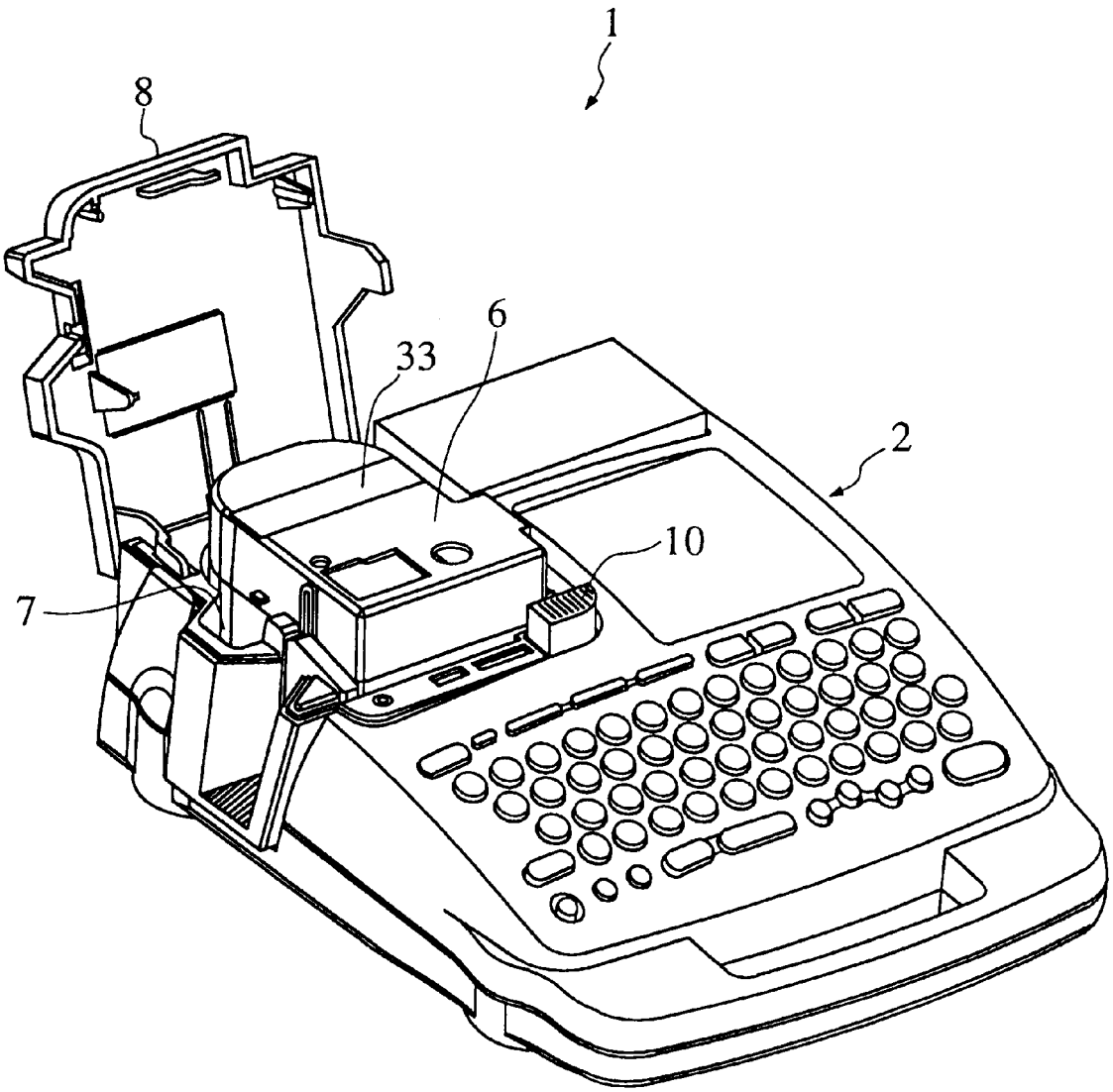
FIG. 14 is a perspective view of the tape printing apparatus having the cartridge set therein for loading.
Figure 15:
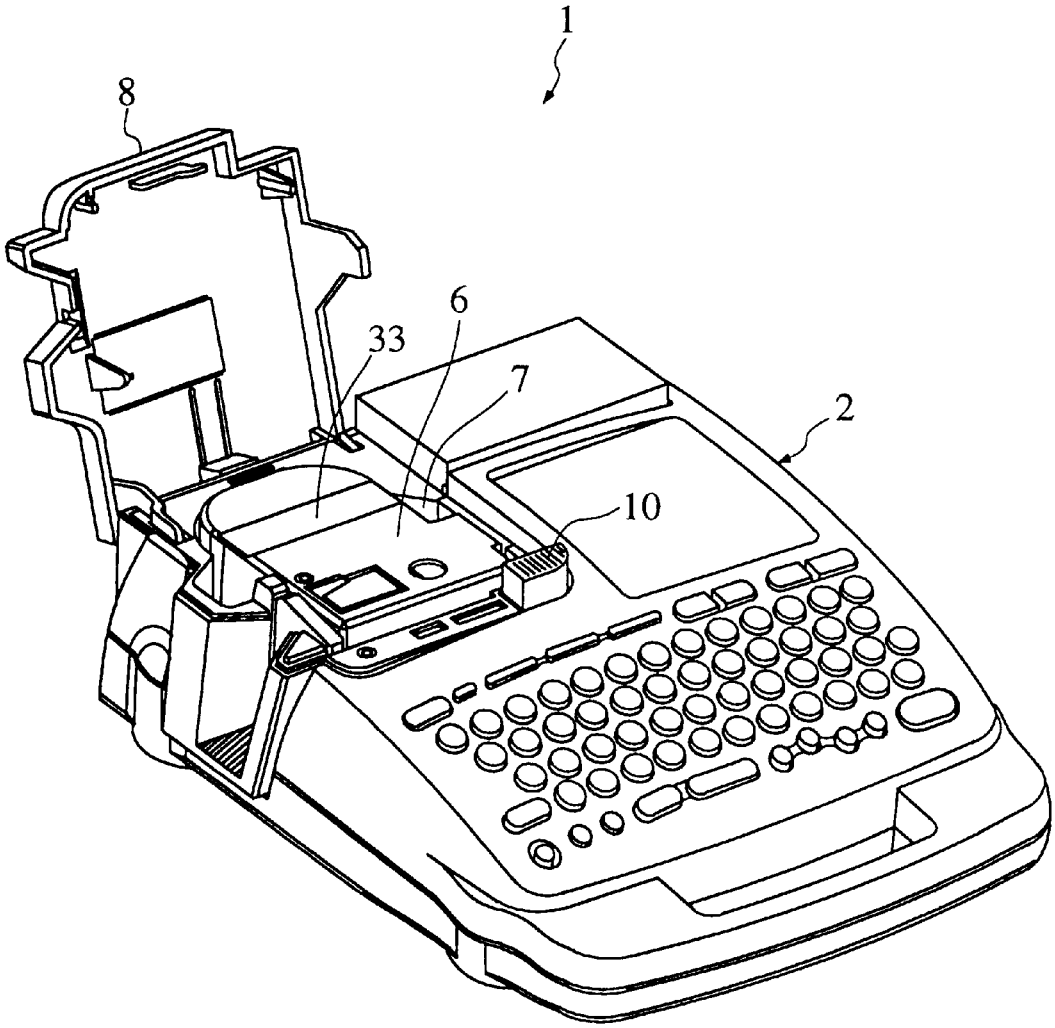
FIG. 15 is a perspective view of the tape printing apparatus having the cartridge completely loaded therein.

When the instruction for a printing operation is given, a tape T and an ink ribbon R contained in the cartridge 6 starts to be fed or run simultaneously, for printing through thermal transfer of ink. As the printing proceeds, the ink ribbon R is taken up within the cartridge 6, whereas a printed portion of the tape T is sent out of the apparatus 1 via a tape delivery slit 11 formed through a side wall of the casing 3. When the printing is completed, the feeding of the tape T for a marginal portion is further carried out and then the tape T and the ink ribbon R are caused to be stopped. Then, an automatic cutting mechanism starts its operation, whereby a cutter, not shown, is actuated to cut off a printed portion from the tape. To take the cartridge 6 out of the apparatus 1, the release button 10 is depressed to let the lid 8 open to its half-open position, and then the lid is manually opened to its fully-open position. In a manner interlocked to this manual opening operation, the ejecting mechanism 9 (see FIG. 13) operates to move the cartridge 6 to the above-mentioned position for removal and setting of a cartridge (see FIG. 14).

Figure 2:
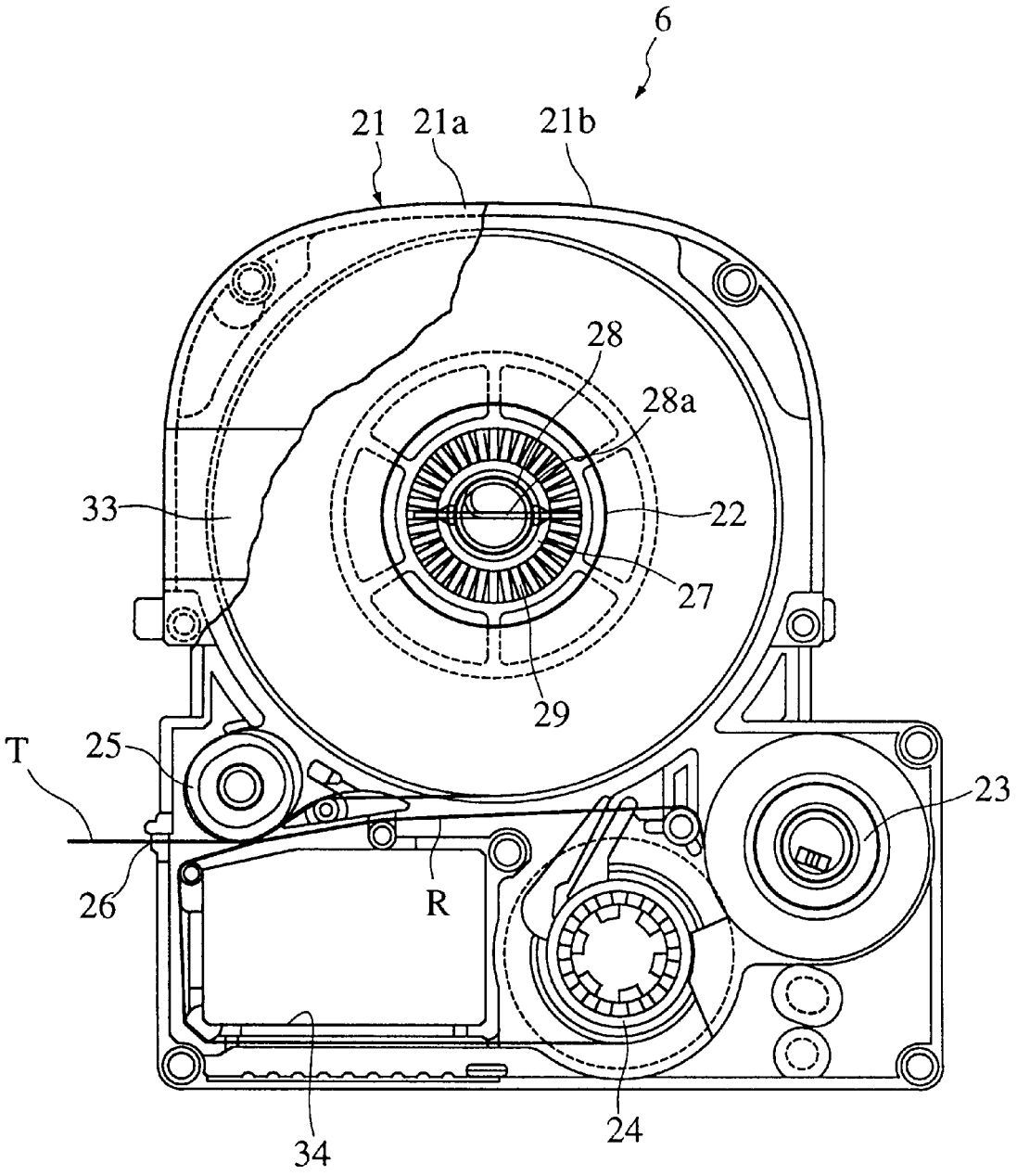
FIG. 2 is a partially-cutaway view of a tape cartridge for use in the FIG. 1 tape printing apparatus.

Referring to FIG. 2, the cartridge 6 includes a casing 21 formed of an upper casing 21*a* and a lower casing 21*b*, and contains therein a tape reel 22 around which the tape T is wound, a ribbon supply reel 23 around which the ink ribbon R is wound, and a ribbon take-up reel 24 for taking up a used portion of the ribbon R, each in a rotatable fashion. Further, the casing 21 contains a platen roller 25 which should be opposed to a print head 53, referred to hereinafter, in a rotatable fashion. When the platen roller 25 and the ribbon take-up reel 24 rotate in a synchronous manner, the tape T and the ink ribbon R are fed simultaneously, and placed on upon the other at the platen roller 25 for printing. After printing, the ink ribbon R is taken up by the ribbon rake-up reel 24 while the tape T is sent out from a tape delivery port 26 which continues to the tape delivery slit 11 of the tape printing apparatus.

The cartridge 6 incorporates a mechanism for preventing a leading end of the tape T from being retracted inside during transport or storage thereof, as well as a tensioning mechanism for preventing the ink ribbon R from becoming loose. The mechanism for preventing retraction of the tape T is comprised of, as shown in FIGS. 2 and 9, a coiled spring 28 arranged on a top of a hollow cylindrical shaft portion 27 of the tape reel 22, and an engaging portion 29 shaped like a crown gear, which is formed on the top of an inner portion of the tape reel 22. A wire portion 28*a* as a bent extension of a lower end of the coiled spring 28 is brought into engagement with the engaging portion 29 in an urged manner. The engagement of the wire portion 28*a* and the engaging portion 29 is effected in a clicking fashion, and hence it is possible to pull the tape T out of the casing 21 by strongly pulling the leading end of the tape T.

Figure 3B:
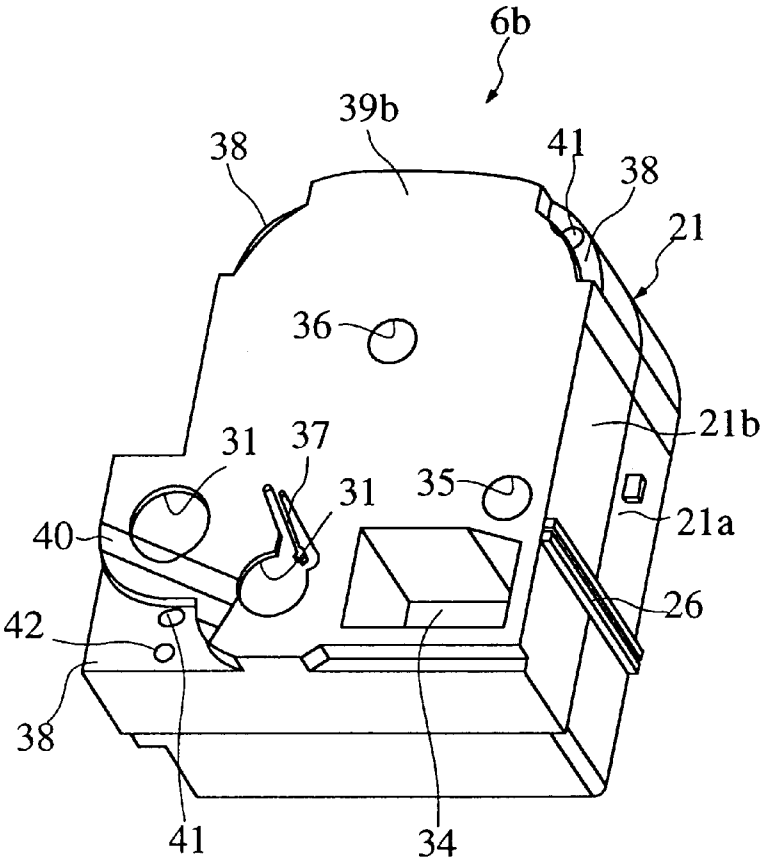
FIG. 3B is a perspective view of a large-height cartridge as viewed from a bottom side.
Figure 3A:
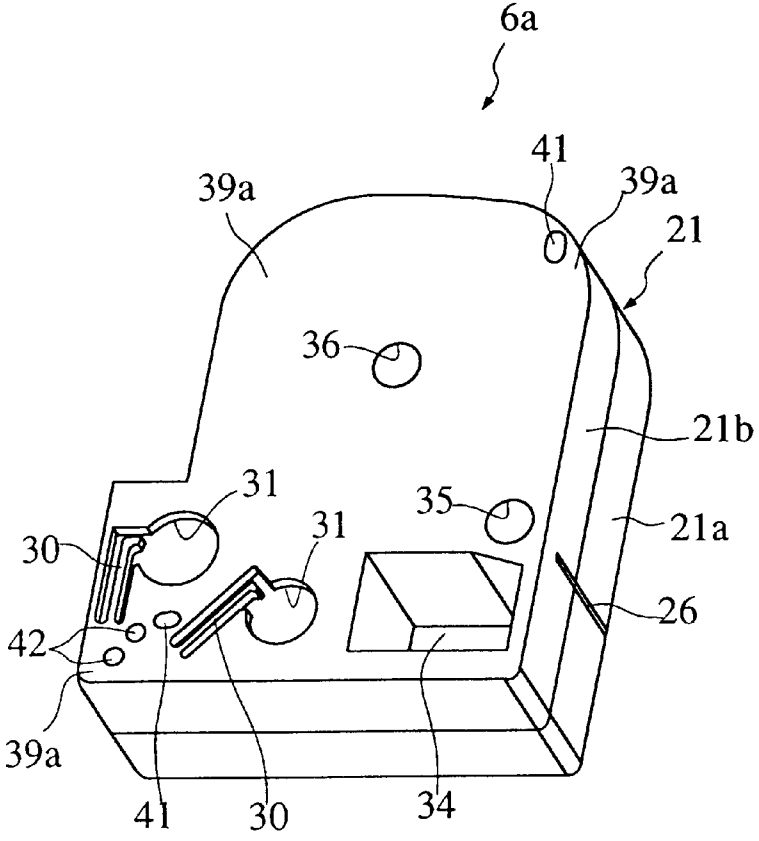
FIG. 3A is a perspective view of a small-height cartridge as viewed from a bottom side.

The mechanism for preventing the loosening of the ink ribbon R is, as shown in FIGS. 3A and 3B, comprised of a pair pawls 30, 30 (in the case of the small-height type), and a pawl 37 (in the case of the large-height type) for engagement with a lower end of the ribbon supply reel 23 and a lower end of the ribbon take-up reel 24. The lower casing 21*b* has a bottom wall formed with a pair of circular through holes 31, 31 in flush with lower ends of the reels 23, 23 having a plurality of radially-extending grooves 32 (see FIGS. 8B, 8D). Further, the lower casing 21*b* is formed with two slits which extend continuous with each of the circular through holes 31 in a substantially parallel fashion, thereby defining the pawl 30 between the slits, which is for engagement with one of the grooves 32. By these mechanisms, the rotation of the tape reel 22 is restricted and the free rotation of the ink ribbon R is inhibited, whereby the loosening of the tape T and the ink ribbon R is prevented. When the cartridge 6 is loaded in the pocket 7, the restriction of rotation of the tape reel 22 and the inhibition of rotation of the ribbon supply reel and the ribbon take-up reel are made ineffective, whereby feeding of the tape T and the ink ribbon R is permitted (details of these mechanisms will be described hereinbelow.)

There are a plurality of kinds of tape T (and ink ribbon R) which are different in width from each other, and there are a plurality of kinds of cartridges 6 suitable for different kinds of tapes (ink ribbons). For example, there are provided six kinds of tape T which have respective tape widths of 6 mm, 9 mm, 12 mm, 18 mm, 24 mm, and 36 mm, while there are three kinds of cartridges, i.e. one for 6 mm-wide, 9 mm-wide, 12 mm-wide tapes, one for 18 mm-wide and 24 mm-wide tapes, and one for a 36 mm-wide tape. The first two kinds of the cartridges for 6 mm-wide, 9 mm-wide, 12 mm-wide, 18 mm-wide, and 24 mm-wide tapes, are conventionally used for tape printing apparatuses of the prior art, but the one for a 36 mm-wide tape T is a new kind which can be used by the tape printing apparatus 1 of the present embodiment. In FIG. 2, reference numeral 33 indicates a seal attached to the surface of the upper casing 21*a*, which contains an entry of one of the above widths of the tape T.

Thus, the tape printing apparatus 1 of the embodiment is capable of using three kinds of the cartridges, i.e. a small-height cartridge, a medium-height cartridge, and a large-height cartridge. The large-height cartridge is two times as high as the small-height cartridge. For loading of these three kinds of cartridges 6 different in height in the pocket 7 and removing of them therefrom without difficulty, proper printing on six kinds of tape T different in width, and further, for upward compatibility with conventionally available small-height type and medium-height cartridges, the tape printing apparatus 1 of the present embodiment realizes various kinds of inventive ideas on the arrangement thereof, including the ejecting mechanism 8. Hereafter, the description will be made mainly on portions designed based on these ideas, and first of all, part of the cartridge 6 concerned with such inventive ideas will be described.

FIGS. 3A and 3B are bottom views of the small-height cartridge 6*a* and the large-height cartridge 6*b*. Since the medium-height cartridge is substantially identical in construction with the small-height cartridge 6*b* (only different in thickness), the description of the medium-height cartridge is omitted. As shown in FIGS. 3A and 3B, the casing 21 of each of the cartridges 6*a*,6*b* is formed with a rectangular opening 34 which extends through the cartridge for receiving the print head 53 therein, and an engaging hole 35 located upward of the through opening 34, as viewed in the figures, for receiving a roller drive shaft 54 (see FIG. 4) which engages with the platen roller 25. Further, at a location corresponding to the tape reel 22, there is formed a hole 36 for inserting a tape reel release projection 56 (see FIG. 4) therein for releasing the tape reel 22 from the coiled spring 28 which restricts the rotation of the tape reel 22.

Further, the above-mentioned pair of circular through holes 31, 31 are formed at locations corresponding to locations of the ribbon supply reel 23 and the ribbon take-up reel 24, respectively, and a reel drive shaft 55 (see FIG. 4) is inserted into one of the circular through holes 31, 31 which corresponds to the ribbon take-up reel 24 for engagement therewith to drive the same for rotation. The small-height cartridge 6*a* (see FIG. 3A) is formed with the above mentioned pair of pawls 30, 30 which face the pair of the circular through holes 31, 31, respectively, while the large-height cartridge 6*b* (see FIG. 3B) is formed with the pawl 37 at one of the circular through holes 31, 31 which corresponds to the ribbon take-up reel 24. The locations of the pawls 30, 30 of the small-height cartridge 6*a* and the location of the pawl 37 of the large-height cartridge 6*b* are different, and accordingly, a first disengaging projection 57 (see FIG. 8A) for disengaging the pawls 30 of the small-height cartridge 6*a* and a second-disengaging projection 58 (see FIG. 8B) for disengaging the pawl 37 of the large-height cartridge 6*b* are also arranged at different positions. (Details of these devices will be described hereinafter.)

On the other hand, the lower casing 21b of the large-height cartridge 6*b* is formed with stepped portions 38 at a plurality of portions of the periphery thereof (see FIGS. 5A and 5B) for preventing support projections 52 formed on a base plate 51 (see FIGS. 5A and 5B) from obstructing the loading of the large-height cartridge 6*b*. That is, the large-height cartridge 6*b* is seated on the base plate 51 via a seating portion 39*b* formed by all the bottom area except the stepped portions 38, whereas portions of the small-height cartridge 6*a* corresponding to these stepped portion of the large-height cartridge 6*b* form seating portions 39*a* via which the cartridge 6*a* is seated on the base plate 51. (Details of these portions will be described hereinafter.) Further, the large-height cartridge 6*b* is formed with a slope 40 at a lower right portion, as viewed in FIG. 3B, which slopes upward from the lowermost bottom surface to the surface of a stepped portion 38 in this corner (lower right corner in the figure). The slope 40 of the large-height cartridge 6*b* forms an urging portion for folding down the first disengaging projection 57 when the large-height cartridge 6*b* is loaded in the pocket 7.

At a portion close to the pawl 37 and at a portion on a diagonal line therefrom, there are provided a pair of location holes 41, 41, respectively, for positioning the cartridges 6*a*, 6*b* within the pocket 7, while at the lower right corner of each of the cartridges 6*a*, 6*b* close to the pawls 30, 37, there are formed detection holes 42 (the number and locations dependent on the width of the tape) for detecting the loading of each cartridge 6*a* or 6*b* in the pocket 7 and the kind of the tape T.

Figure 4:
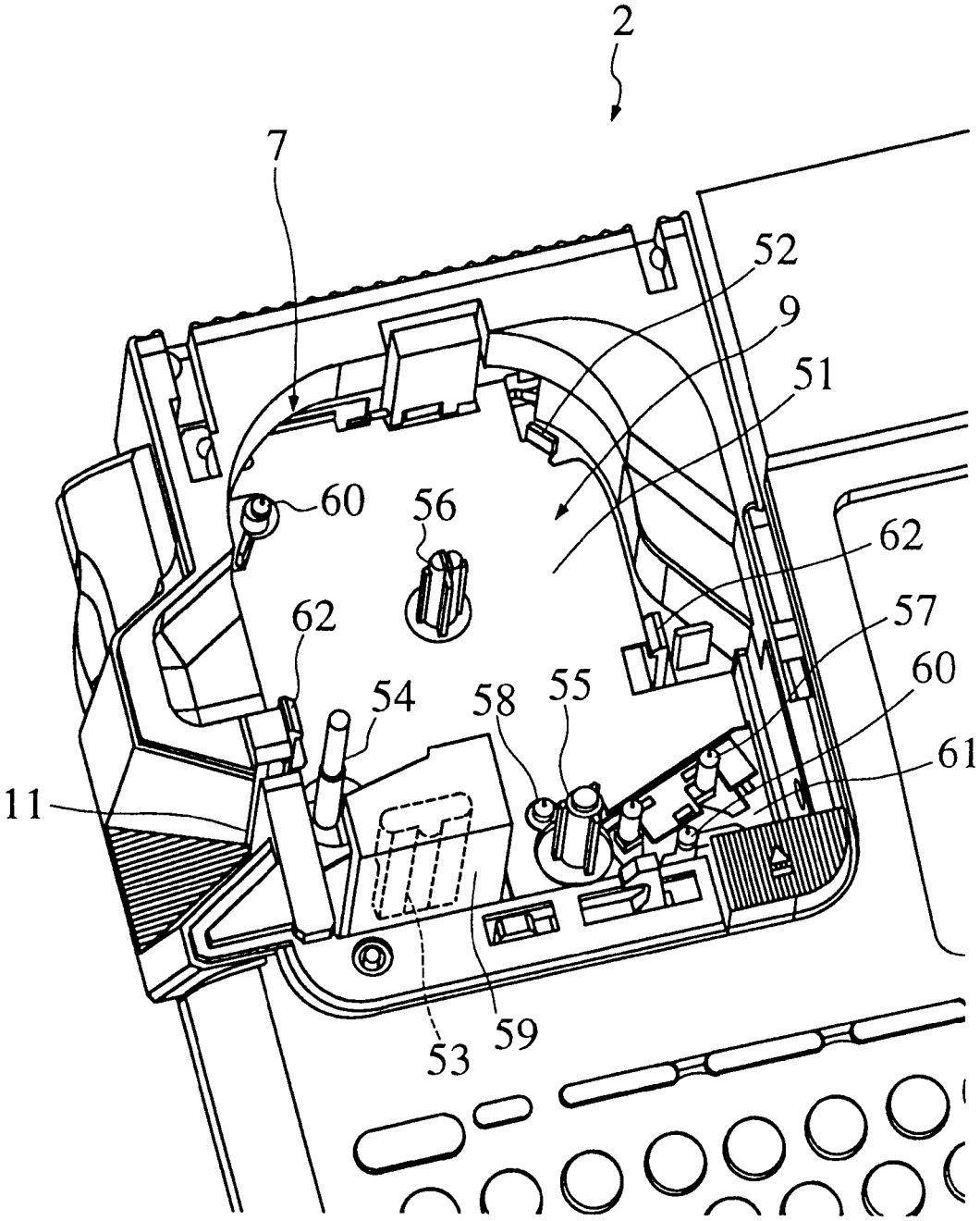
FIG. 4 is a partial perspective view showing a pocket having a lid detached therefrom and part surrounding the pocket.

When the cartridge 6 thus constructed is loaded in the pocket 7 formed in the body of the apparatus, various devices on the body 2 gain access to associated devices on the cartridge 6 and connected thereto. FIG. 4 shows the bottom of the pocket 7 with the base plate 51 of the ejecting mechanism 9 being in its lowermost position. As shown in the figure, the base plate 51 of ejecting mechanism 9 is formed with the aforementioned support projections 52 at the three locations (see FIGS. 17 and 17A). Further, the print head 53, the roller drive shaft 54, the reel drive shaft 55, the tape reel release projection 56, the first disengaging projection 57 and the second disengaging projection 58 extend through respective cut-out portions formed in the base plate 51 into the pocket 7. The print head 53 alone is covered with a head cover 59 on which the rectangular opening 34 of the cartridge 6 is fitted. Further, there are provided three pushers, i.e. a pair of dowels 60, 60 corresponding to the location holes 41, 41, and a detector switch 61 corresponding to one of the above-mentioned detection hole 42. Reference numerals 62, 62 in the figure show a pair of hooks for engagement with sides of the cartridge 6 loaded in the pocket 7 to fixedly hold the cartridge 6 therein.

The relationship between the cartridge 6 per se (body) and component devices thereof, and the above-mentioned various devices on the body 2 connected to respective associated devices of the cartridge 6 will be described while comparing a state of the small-height cartridge 6*a* loaded in the pocket 7 and a state of the large-height cartridge 6*b* loaded in the same.

Figure 5A:
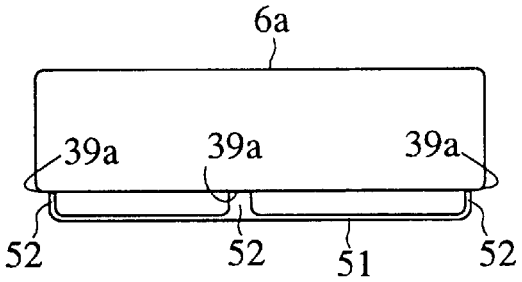
FIG. 5A is a schematic diagram showing the small-height cartridge in a state loaded in the pocket, as viewed from a side.
Figure 5B:
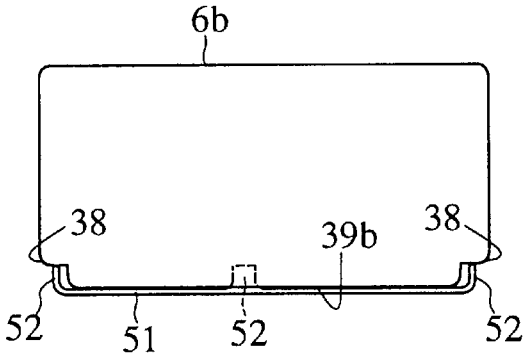
FIG. 5B is a schematic diagram showing the large-height cartridge in a state loaded in the pocket, as viewed from a side.

FIG. 5A schematically shows a state of the small-height cartridge 6*a* loaded in the pocket 7 while FIG. 5*b* schematically shows a state of the large-height cartridge 6*b* loaded in the same. As described hereinabove, in the case of the large-height cartridge 6*b*, all the surface of the bottom except for the surfaces of the stepped portions 38 form the seating portion 39*b*, whereas in the case of the small-height cartridge 6*a*, the portions of the small-height cartridge 6*a* corresponding to the stepped portions 38 of the large-height cartridge 6*b* forms the seating portions 39*a* via which the cartridge 6*a* is seated or rests on the base plate 51. In corresponding thereto, the base plate 51 is formed with the three support projections 52, 52, 52 by cutting three support portions of the periphery thereof and bending the cut portions upward. That is, the three projections 52, 52, 52 form first support means for supporting the small-height cartridge 6*a*, and the flat surface of the base plate 51 forms second support means for supporting the large-height cartridge 6*b*.

When the small-height cartridge 6*a* is loaded in the pocket 7, it is supported by the three support projections 52 in a state lifted above the flat surface of the base plate 51 (see FIG. 5A). On the other hand, when the large-height cartridge 6*b* is loaded in the pocket 7, it is supported by the flat surface of the base plate 51 by receiving the three support projections 52 in spaces provided by the stepped portions 38 (see FIG. 5B). Thus, when the small-height cartridge 6*a* or the large-height cartridge 6*b* is loaded in the pocket 7, the former is held in a shallow or upper position, while the latter is held in a deep or lower position, thereby preventing the small-height cartridge 6*a* from being inserted excessively deep into the pocket 7.

This makes it possible to elevate each kind of cartridge 6 up to a position from which it can be easily removed from the pocket 7, without changing the elevating stroke of the ejecting mechanism 9 in dependence on the thickness of the cartridge 6. Further, it is not required to carry out special machining on the small-height cartridge 6*a*, which enables the conventional cartridges to be used as they are. Although in this embodiment, the small-height cartridge 6*a* is supported by the three support projections 52, this is not limitative but the construction of support means and the number of members therefor can be changed as desired so long as they can hold the small-height cartridge 6*a* in an upper position, and the large-height type cartridge 6*b* in a lower position. Further, this construction can be applicable to a tape printing apparatus without the ejecting mechanism 9.

Figure 6A:
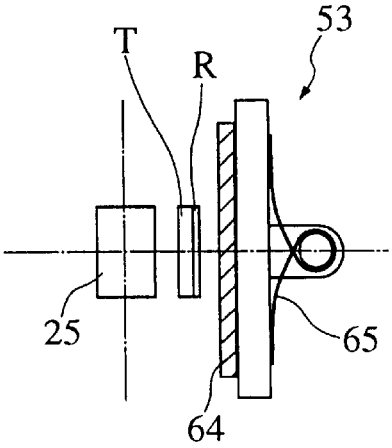
FIG. 6A is a schematic cross-sectional view showing the alignment of a tape within the small-height cartridge and a print head.
Figure 6B:
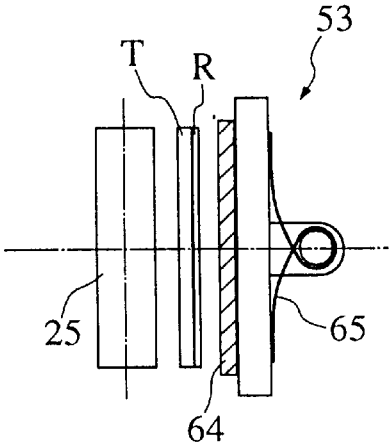
FIG. 6B is a schematic cross-sectional view showing the alignment of a tape within the large-height cartridge and the print head.

As shown in FIG. 6B, the large-height cartridge 6*b* containing the tape T (and the rink ribbon R: 36 mm in width) is received in the pocket 7 to the full depth thereof, whereas the small-height cartridge 6*a* containing the tape T (and the ink ribbon R: 6 mm in width) is set in the pocket 7 in a elevated position, as shown in 6A. Therefore, both the tapes T are positioned to have their vertically central portion thereof correspondent to a position of half the depth of the pocket 7. This state of setting of the tape T will be further described in relation to the print head 53 and the platen roller 25. The print head 53 is provided with an array of heating elements 64 arranged vertically, and pivotally supported by a weak spring 65 at a vertically midway portion thereof in its upright position. This enables the heating elements 64 to be uniformly urged against the platen roller 25.

For example, in FIG. 6A, when the tape T (6 mm) is deviated downward from its proper position, if the print head 53 is urged thereon, the print head 53 is inclined to produce a gap between a lower part of the tape T and the heating elements 64, causing an unclear printing. To avoid this inconvenience, the cartridges are held such that the center of each of various kinds of tapes is at a vertically midway point of the pocket 7, i.e. a vertically midway point of the array of thermal heads, thereby preventing the printing from being unclear even if tapes having different widths are used.

Next, referring to FIGS. 7A and 7B, the relationship of the platen roller 25 (rotating member) of the cartridge 6 and the roller drive shaft 54 will be described. As shown in the figures, in the cartridge 6, there is arranged a shaft member 67 of the platen roller 25 which is fitted in the engaging hole 35. The shaft member 67 is formed with a large-diameter shaft hole 68 and a small-diameter shaft hole continuous with the large-diameter shaft hole 68 extending upward. On the other hand, the roller drive shaft 54 is comprised of a drive shaft body 70, a center pin 71 supporting the dive shaft body 70 such that the drive shaft body 70 is rotatable and axially movable, and a coiled spring 72 for urging the drive shaft body 70 upward.

The drive shaft body 70 is comprised of an engaging portion 73 for spline engagement with the large-diameter shaft hole 68 and a gear portion 75 for mating with a counter part of an output shaft 74 on the drive source side. The center pin 71 is comprised of a pin body 76 extending into the small-diameter shaft hole 69 and a support portion 77 supporting the pin body 76. The drive shaft body 70 has a lower part including the gear portion 75 formed such that the lower part covers the support portion 77 of the center pin 71. A coiled spring 72 is interposed between an inner peripheral surface of the lower part of the drive shaft body 70 and an outer peripheral surface of the support portion 77 of the center pin 71, such that it is loosely fitted around the center pin 71.

Figure 7B:
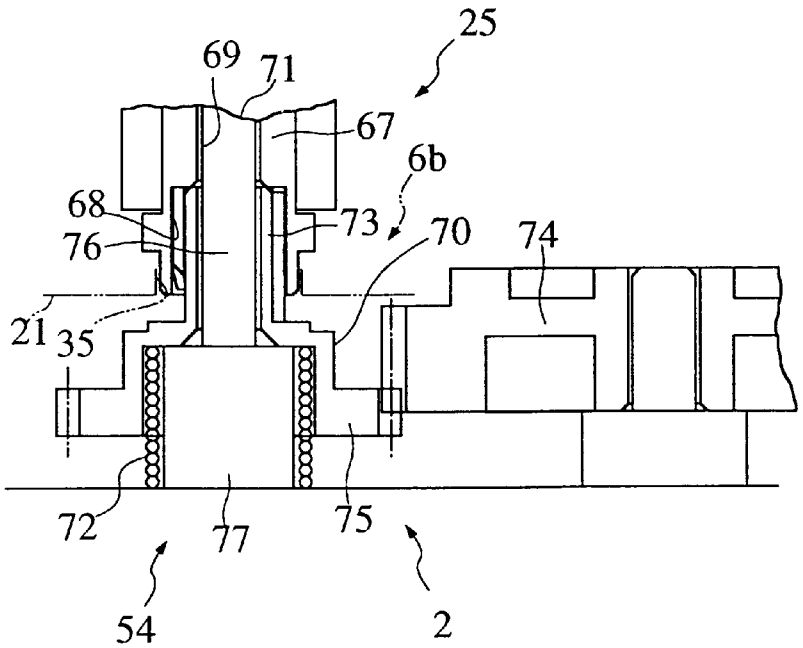
FIG. 7B is a fragmentary cross-sectional view showing the arrangement of a platen roller of the large-height cartridge and the roller drive shaft for driving the platen roller.
Figure 7A:
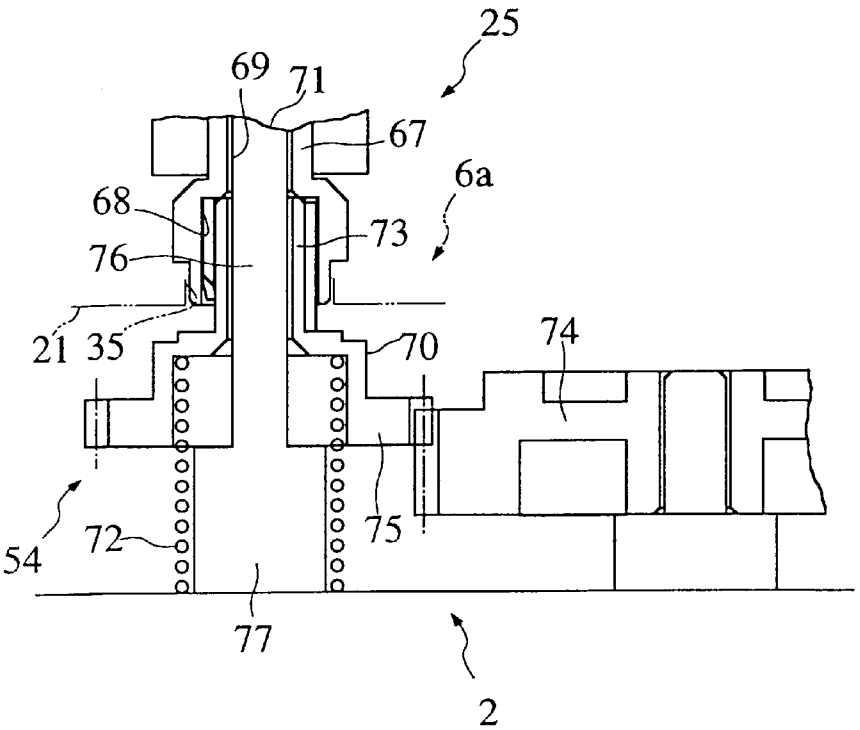
FIG. 7A is a fragmentary cross-sectional view showing the arrangement of a platen roller of the small-height cartridge and a roller drive shaft for driving the platen roller.

FIG. 7A shows a state of the small-height cartridge 6*a* loaded in the pocket 7, while FIG. 7B shows a state of the large-height cartridge 6*b* loaded in the same. As shown in FIG, 7A, when the small-height cartridge 6*a* is loaded, it is held in the shallow position within the pocket 7 as described above, so that the drive shaft body 7 biased by the coiled spring 72 is sunk to a small extent, thereby preserving proper engagement of the roller drive shaft 54 and the platen roller 25. On the other hand, when the large-height cartridge 6*b* is loaded, it is held in the deep position within the pocket 7 (FIG. 7B) as described above. Therefore, the drive shaft 70 biased by the coiled spring 72 is sunk largely or to a deep position, thereby preserving proper engagement of the roller drive shaft 54 and the platen roller 25. That is, the roller drive shaft 54 is properly engaged in the cartridge irrespective of its kind 6*a* or 6*b*, for rotation of the platen roller.

Next, referring to FIGS. 8A to 8D, the relationship between the pawls 30, 37 of the cartridges 6 and the first disengaging projection 57 and the second disengaging projection 58 on the body 2 side will be described. As shown in these figures, the first disengaging projection 57 is formed by a pair of projections 80, 80, a connecting portion 81 connecting the projections 80, 80, and torsion coil spring 82 urging the pair of projections 80, 80 via the connecting portion such that the projections are each in an upright position. The connecting portion 81 is rotatably supported by the body 2, and the pair of projections 80, 80 are provided at respective locations which correspond to the pair of pawls 30, 30 provided on the small-height cartridge 6*a* when it is loaded in the pocket 7. On the other hand, the second disengaging member 58 is arranged in the vicinity of the reel drive shaft 55 in a fixed upright position. The second disengaging projection 58 extends upward to a level lower than the bottom of the small-height cartridge 6*a* loaded in the pocket 7.

Figure 8A:
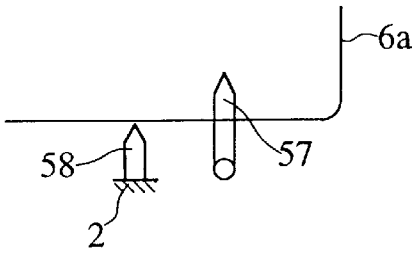
FIG. 8A is a schematic diagram showing the small-height cartridge and release projections, as viewed from a side.
Figure 8B:
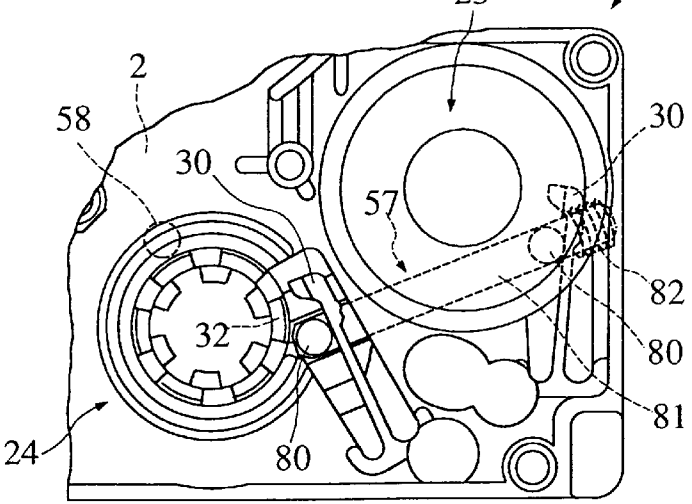
FIG. 8B is a fragmentary view showing the internal construction of the cartridge including a take-up reel and a supply reel contained in the small-height cartridge, and release projections.
Figure 8C:
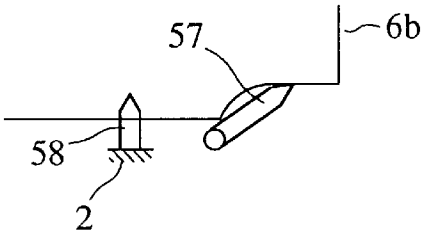
FIG. 8C is a schematic diagram showing the large-height cartridge and release projections, as viewed from a side.
Figure 8D:
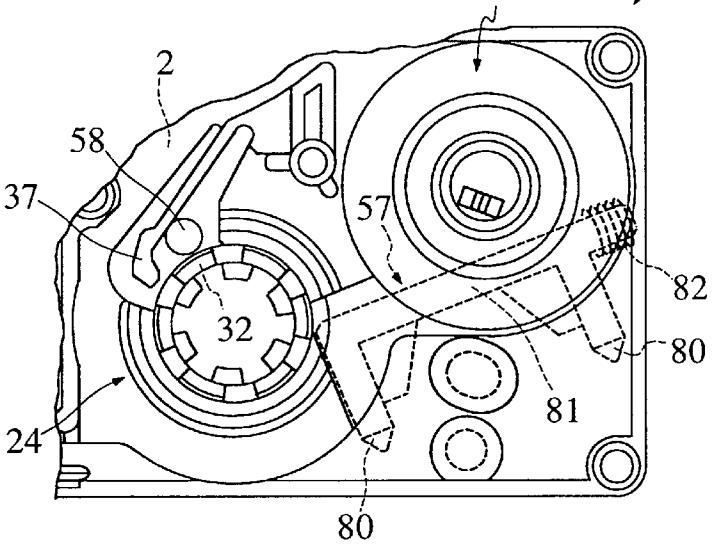
FIG. 8D is a fragmentary view showing the internal construction of the cartridge including a take-up reel and a supply reel contained in the large-height cartridge, and release projection.

As shown in FIG. 8A and 8B, when the small-height cartridge is loaded in the pocket 7, the pair of projections 80, 80 of the first disengaging projection 57 are brought into urging contact with the pair of pawls 30, 30 of the small-height cartridge 6*a*, thereby causing the pawls 30, 30 to be moved away from the grooves, not shown, of the ribbon supply reel 23 and the grooves 32 of the ribbon take-up reel 24. This sets the ribbon supply reel 23 and the ribbon take-up reel 24 in respective rotatable states. Further, the small-height cartridge 6*a* is held in the shallow or upper position within the pocket 7, above the upper end of the second disengaging projection 58, so that it is free from objection thereof.

On the other hand, when the large-height cartridge 6*b* is loaded in the pocket 7, the second disengaging member 58 urges the pawl 37 of the large-height cartridge 6*b* upward, whereby the pawl 37 is bent away from one of the grooves 32 on the ribbon take-up reel 24 to be disengaged therefrom. Further, the slope 40 on the bottom of the large-height cartridge 6*b* is brought into contact with the pair of projections 80, 80 of the first disengaging projection 57, to forcibly fold down the projections 80, 80 against the urging force of the torsion coil spring 82. This prevents the first disengaging projection 57 from obstructing the loading of the large-height cartridge 6*b*.

Thus, when the small-height cartridge 6*a* is loaded, the second disengaging projection 58 is away from the small-height cartridge 6*a*, whereas when the large-height cartridge 6*b* is loaded, the first disengaging projection 57 is folded, whereby the engagement of the first disengaging projection 57 with the small-height cartridge 6*a* and the engagement of the second disengaging projection 58 with the large-height cartridge 6*b* can be effected without causing any trouble.

Figure 9A:
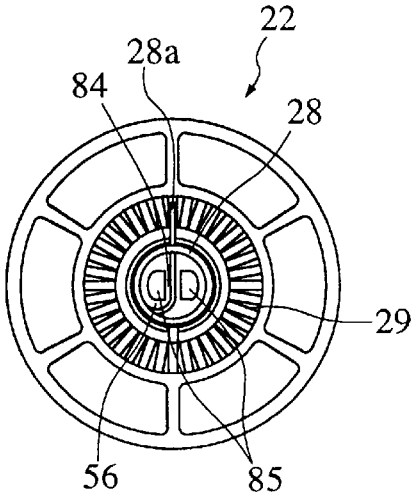
FIG. 9A is a diagram showing the relationship in position between a tape reel of the small-height cartridge and a tape reel release projection, as viewed from above.
Figure 9C:
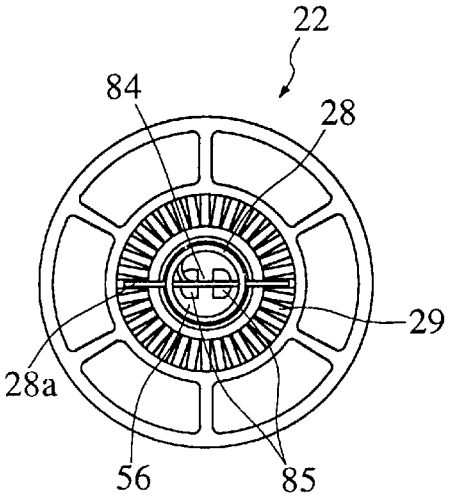
FIG. 9C is a diagram showing the relationship in position between a tape reel of the large-height cartridge and the tape reel release projection, as viewed from above.
Figure 9B:
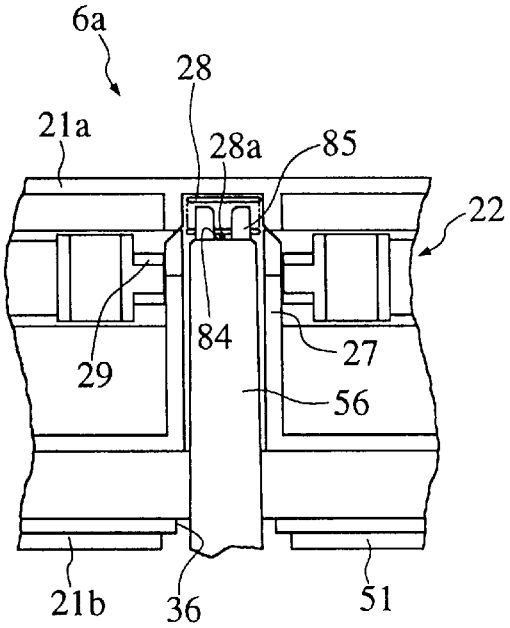
FIG. 9B is a diagram showing the relationship in position between the tape reel of the small-height cartridge and the tape reel release projection, as viewed from a side.
Figure 9D:
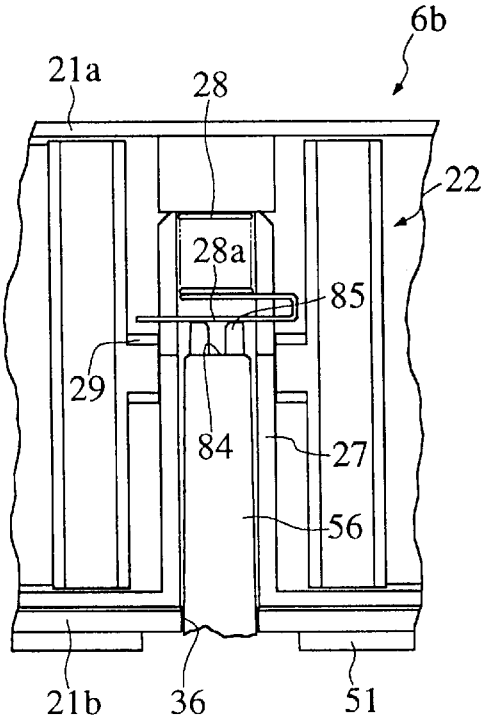
FIG. 9D is a diagram showing the relationship in position between the tape reel of the large-height cartridge and the tape reel release projection, as viewed from a side.

Next, the relationship between the tape reel 22 of the cartridge 6 and the tape reel release projection 56 of the body 2 will be described with reference to FIGS. 4 and 9A to 9D. As shown in FIG. 4, the tape reel release projection 56 is formed on the body 2 in a fashion extending upright through a central portion of the base plate 51. As best shown in FIGS. 9B and 9D, the tape reel release projection 56 has its upper end divided into two small projections spaced from each other. A portion of the surface defined between the two small projections forms a first urging portion 84 for being brought into contact with the coiled spring 28 of the small-height cartridge 6*a*, and the top surface of each of the two small projections forms a second urging portion 85. More specifically, the wire portion 28*a* of the coiled spring 28 fitted in the hollow cylindrical shaft portion 27 of the tape reel 22 extends in a longitudinal direction within the small-height cartridge 6*a*, while the same extends in a transverse direction within the large-height cartridge 6*b*. The tape reel release projection 56 is formed such that the first engaging portion 84 extends longitudinally in a fashion corresponding to the wire portion 28*a* within the small-height cartridge 6*a*.

As shown in FIG. 8B, when the small-height cartridge 6*a* is loaded in the pocket 6*a*, the wire portion 28*a* of the coiled spring 28 of the small-height cartridge 6*a* is brought into contact with the first urging portion 84 to be lifted upward, whereby the wire portion 28*a* is disengaged from the engaging portion 29. This sets the tape reel 22 in a freely rotatable state. Further, as shown in FIG. 9D, when the large-height cartridge 6*b* is loaded, the wire portion 28*a* of the coiled spring 28 is brought into contact with the second urging portion 85 to be lifted upward, whereby the wire portion 28*a* is disengaged from the engaging portion 29.

Thus, when the small-height cartridge 6*a* is loaded, the wire portion 8*a* is brought into contact with the first urging portion 84 without being obstructed by the second urging portion 85, whereas when the large-height cartridge 6*b* is loaded, the wire portion 28*a* brought into contact with the second urging portion 85 without reaching the first urging portion 84. Therefore, when any of the small-height type and large-height cartridges 6*a*, 6*b* is loaded in the pocket, the disengagement of the coiled spring 28 from the engaging portion 29 can be properly and reliably effected.

Figure 10:
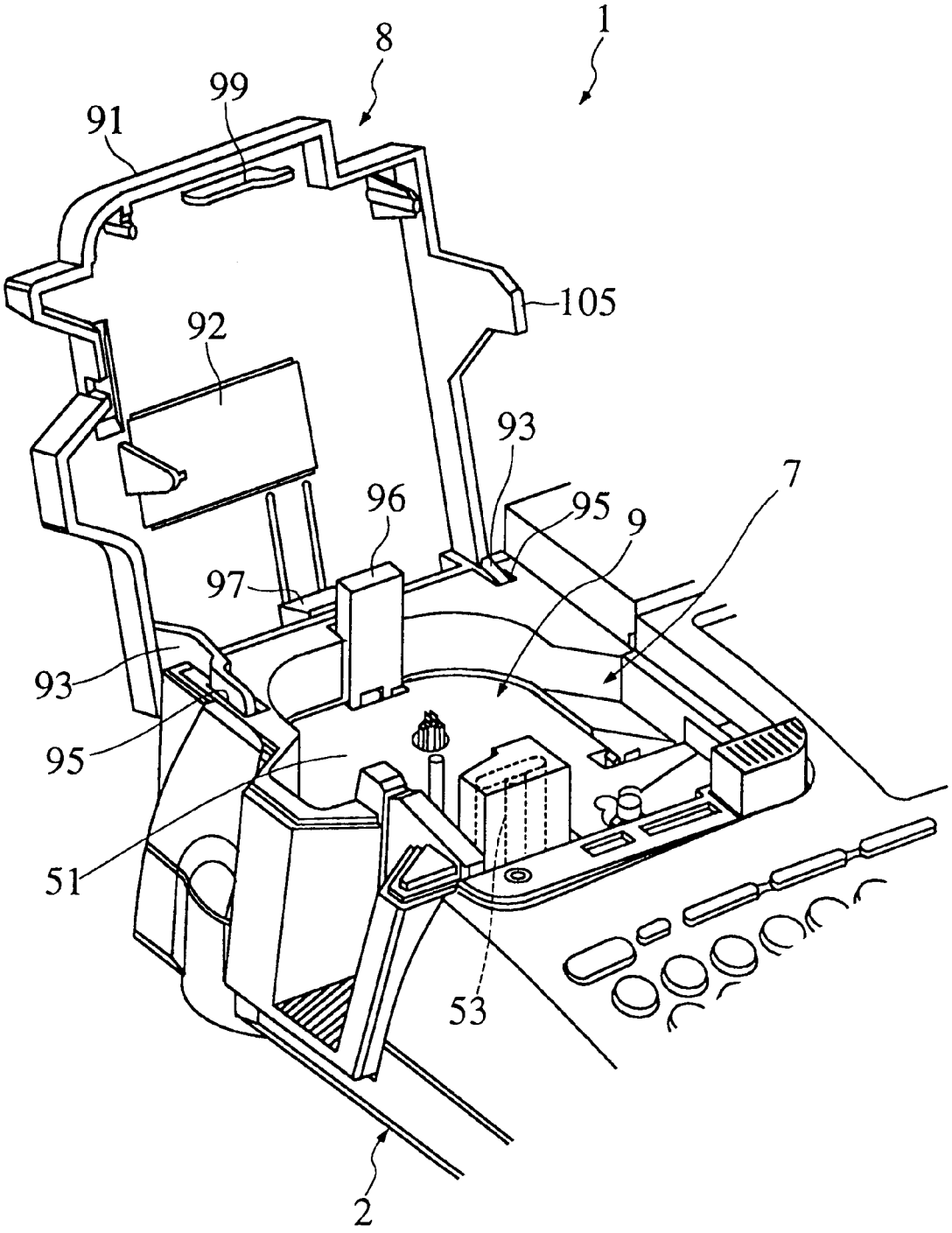
FIG. 10 is a fragmentary perspective view showing a lid arranged on a body of the cartridge.
Figure 11:
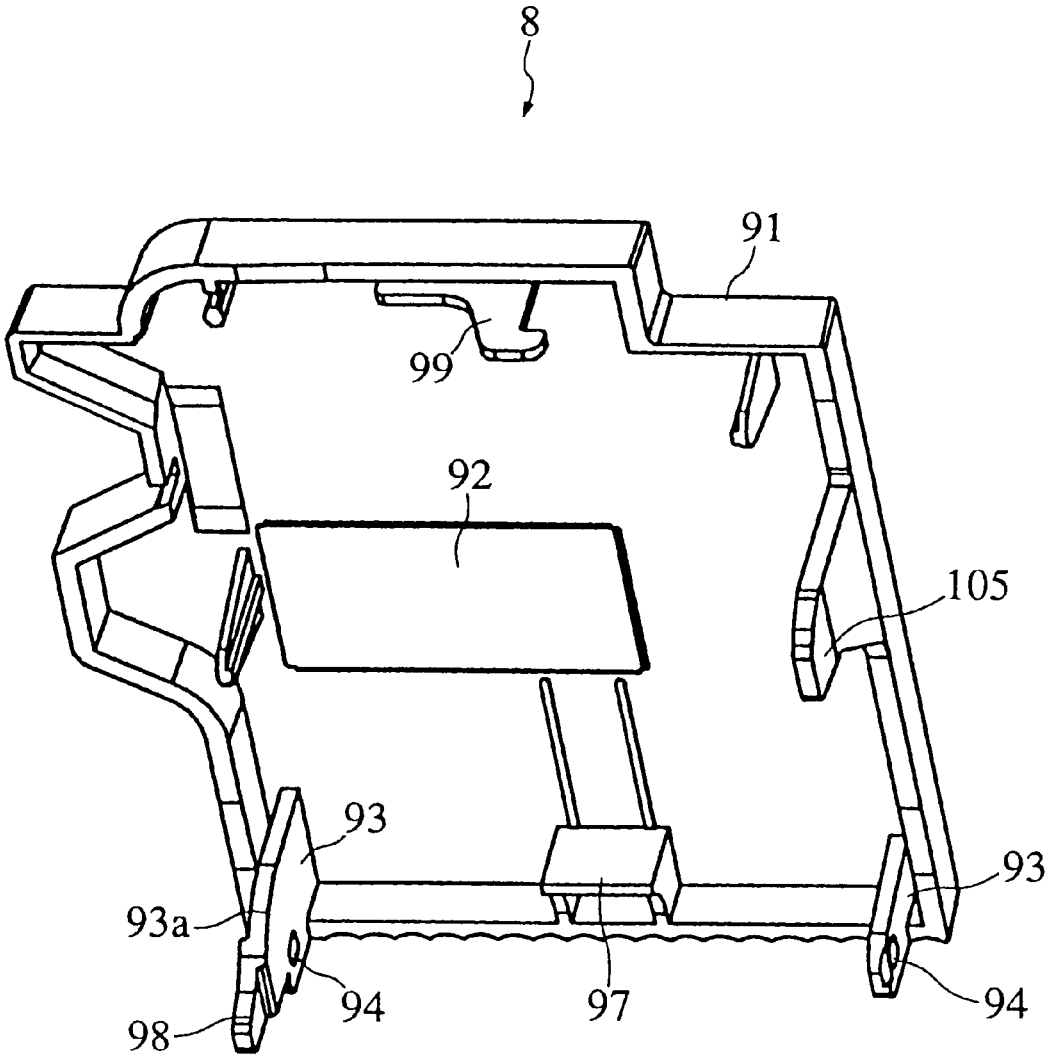
FIG. 11 is a perspective view of the lid as viewed Mu from underside.

Next, the lid 8 and component parts associated therewith will be described. Referring to FIGS. 10 and 11, the lid 8 has a lid body 91 formed with the window 92 opening in a central portion thereof, and has a left-side portion thereof formed into a V-shape to the shape of the tape delivery slit 11 of the body 2. The lid has its rear end formed with a pair of hinge pieces 93, 93 on respective left and right sides, as viewed in the figure, each of which is formed with a circular engaging through hole 94. The hinge pieces 93,93 are inserted into a pair of slits 95 arranged at a rear end of the body 2 on respective left and right sides, for being rotatably engaged with engaging projection, not shown, which projects inward of each slit 95. Each engaging projection has a semi-spherical shape, and is engaged with the engaging hole 94 in a lateral direction from outside. That is, the pair of hinge pieces 93, 93 and the pair of engaging projections form the hinge of the lid 8.

Further, each hinge piece has a resilient property, and constructed such that it can be detached from the engaging projection. Therefore, if an excessive force is applied to the lid 8, it is detached from the body 2. That is, in case the user attempts to forcibly close the lid 8 in a state of the cartridge 6 being not properly loaded in the pocket 7, an obstructing member 96 obstructs the closing of the lid 8 to detach the hinge pieces 93 from the body 2.

The above mechanism will be described in further detail. As shown in FIG. 10, the ejecting mechanism 9 has an rectangular obstructing member 96 arranged in an upwardly projecting manner, while an abutment member 97 is arranged in the center of the underside of a rear end of the lid 8 in a projecting manner. The obstructing member 96 is pivotally arranged on the base plate 51, and urged to an upright position by a spring, not shown. This causes the obstructing member to be moved up and down together with the base plate 51, and can be folded forward against the urging force of the spring. That is, if the user closes the lid 8 when the cartridge is not set in the pocket 7 (provided that the base plate 51 is in its uppermost position), the obstructing member 96 is pushed forward by the abutment member 97 to be folded down toward the front side. However, if the user attempts to close the lid 8 with the cartridge 6 set in the pocket 7 (see FIG. 14), the obstructing member 96 is held in its upright position by the cartridge 6, so that the lid 8 is detached from the body 2 due to a force of the obstructing member 96 reactionary to the urging force applied thereto via the abutment member 97.

As will be described in detail hereinafter, when the base plate 51 is in its uppermost position, the cartridge 6 set in the pocket 7 is not fully loaded in the pocket 7, i.e. in a provisionally loaded state. The provision of the obstructing member 96 for obstructing the improper closing of the lid 7 makes it possible to notify the user of the provisionally loaded state of the cartridge 6. Moreover, if the user carelessly attempts to forcibly close the lid 8, the lid is only detached from the body 2, which effectively prevents the lid 8 or the cartridge 6 from being broken. Further, when the cartridge 6 is not set in the pocket 7, the obstructing function of the obstructing member is in a disabled state, so that apparatus 1 can be easily set to a standby state by closing the lid 8.

One of the two hinge pieces 93, 93 arranged on the left-side extends downward to form a downward extension 98 as viewed in FIG. 11. The downward extension 98 is engaged with the ejecting mechanism 9. The downward extension 98 operates to unlock the ejecting mechanism 9, and cooperates with a spring 117*b* (see FIGS. 17 and 17A) of the ejecting mechanism 9 to hold the lid 8 in the half-open state (in the half-open position). That is, if the release button 10 is depressed when the lid 8 is in the fully-closed position, the lid 8 is caused to be elevated upward by the urging force of the spring 117*b* of the ejecting mechanism 9. Further, if the lid 8 is manually operated to open it to the fully-open position, the ejecting mechanism 9 is unlocked to bring the base plate 51 from its lowermost position to its uppermost position, thereby carrying out ejecting operation (details of the operation will be described hereinafter.)

Figure 12:
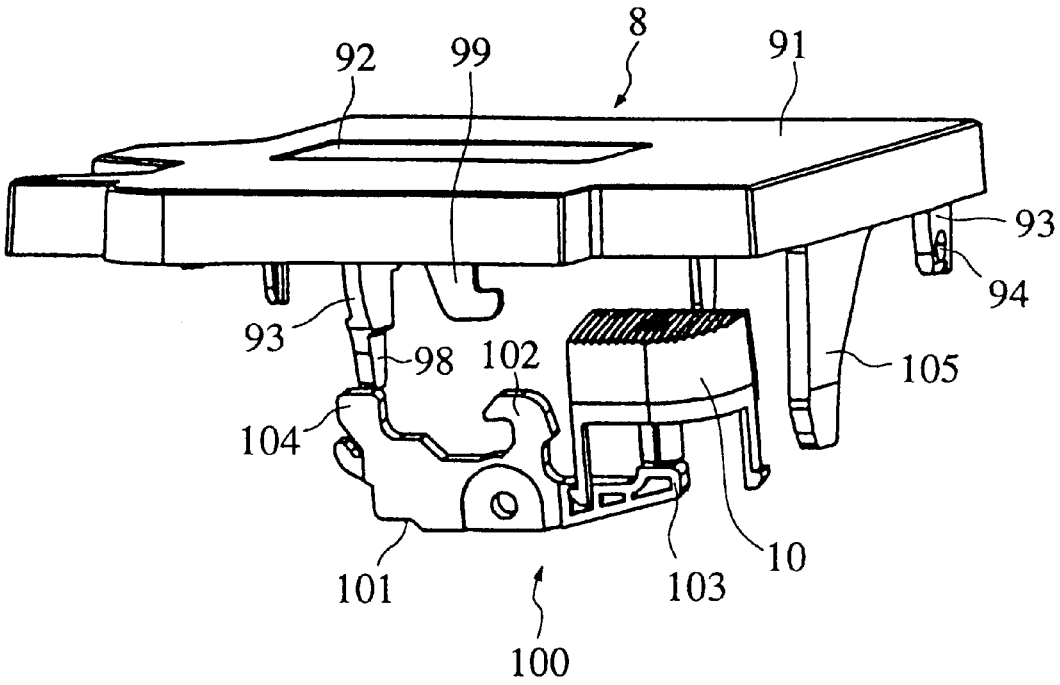
FIG. 12 is a diagram showing, in perspective, the relationship between the lid and a release operation mechanism, as viewed from a side.

On the other hand, a hook 99 extends on the underside of a front portion of the lid 8, which is detachably engaged with an opening operation device 100 of the body 2. The opening operation device 100 is, as shown in FIG. 12, comprised of the above-mentioned release button 10, an engaging member 101 actuated by the release button 10, and a spring, not shown, urging the engaging member in an engaging direction. The engaging member 101 is rotatably supported in the body 2, and has a catching portion 102 formed at an upper intermediate portion thereof for catching the hook 99. Further, the engaging member 101 has one end thereof formed with an abutment portion 103 with which the release button 10 is brought into contact, and the other end thereof with an urging portion 104 for urging the lid 8.

When the lid 8 is closed, the hook 99 causes the engaging member 101 to rotate against the urging force of the spring and is hooked on the catching portion 102. On the other hand, if the release button 10 is depressed when the lid 8 is in the closed state, this causes the engaging portion 101 to rotate against the urging force of the spring to disengage the hook 102 from the catching portion 102, whereupon the urging portion 104 pushes the lid 8 upward, and then the lid 8 is pivotally rotated upward by the urging force of the spring 17*b* of the ejecting mechanism, as described above. Reference numeral 105 in FIG. 12 shows an operating element for causing the print head 53 to be urged toward the platen roller 25 by way of an link, not shown. When the lid 8 is opened, the print head 53 is rotated to a standby position for permitting the loading of the cartridge 6, while when the lid 8 is closed, the operating element 105 causes the print head 53 to be rotated toward the platen roller 25 into an operative position.

Next, referring to FIGS. 13 to 16 the opening operation of the lid 8 will be described in a manner associated with the ejecting operation of the cartridge 6. From the fully closed state of the lid 8 as shown in FIG. 1, first, the release button 10 is depressed to cause the lid 8 to be opened to the half-open position, and then the lid 8 is manually operated to the fully-open position. In this state, the base plate 51 of the ejecting mechanism 9 is in its uppermost position (see FIG. 13). Then, a desired cartridge 6 is placed on the base plate 51 for setting the same in the pocket 7. In this state, the cartridge 6 has its lower half received in the pocket 7 and is in an elevated position (see FIG. 14).

Then, the cartridge 6 is manually depressed downward to be pushed deep into the pocket 7. When the cartridge 6 is pushed to its proper depth, the base plate 51 is locked, and the cartridge 6 is in a state properly loaded in the pocket (see FIG. 15). Then, the lid 8 is closed as shown in FIG. 1. When the lid 8 is closed, the print head 5 is in a position urged toward the platen roller side and on standby for printing.

Thereafter, characters are entered by operating the key entry block 4 (keyboard), and printing is carried out based on the entered text. After entry of the text (or just before printing), the user may wish to check the seal 33 on the cartridge loaded in the pocket 7 to ascertain the width of the tape T contained in the cartridge 6. In such a case, the user push the release button 10 again to bring the lid 8 to the half-open position (see FIG. 16). In this state, the top surface of the cartridge 6 is exposed and the seal 33 can be ascertained.

When the seal 33 is ascertained, if it is not necessary to replace the cartridge 6, the lid 8 is manually operated from the half-open position to the fully-closed position. If it is necessary to replace the cartridge 6, the lid 8 is manually opened from its half position to its fully-open position. This fully-opening operation of the lid 8 unlocks the base plate 51 in an interlocked manner, and the base plate 51 is moved from its lowermost position to its uppermost position to bring the cartridge 6 to its elevated position (the state shown in FIG. 14). Then, after replacing the cartridge 6 by a desired one, the cartridge 6 newly set is properly loaded in the pocket 7 and the lid is closed, following the same procedure described above.

Figure 16:
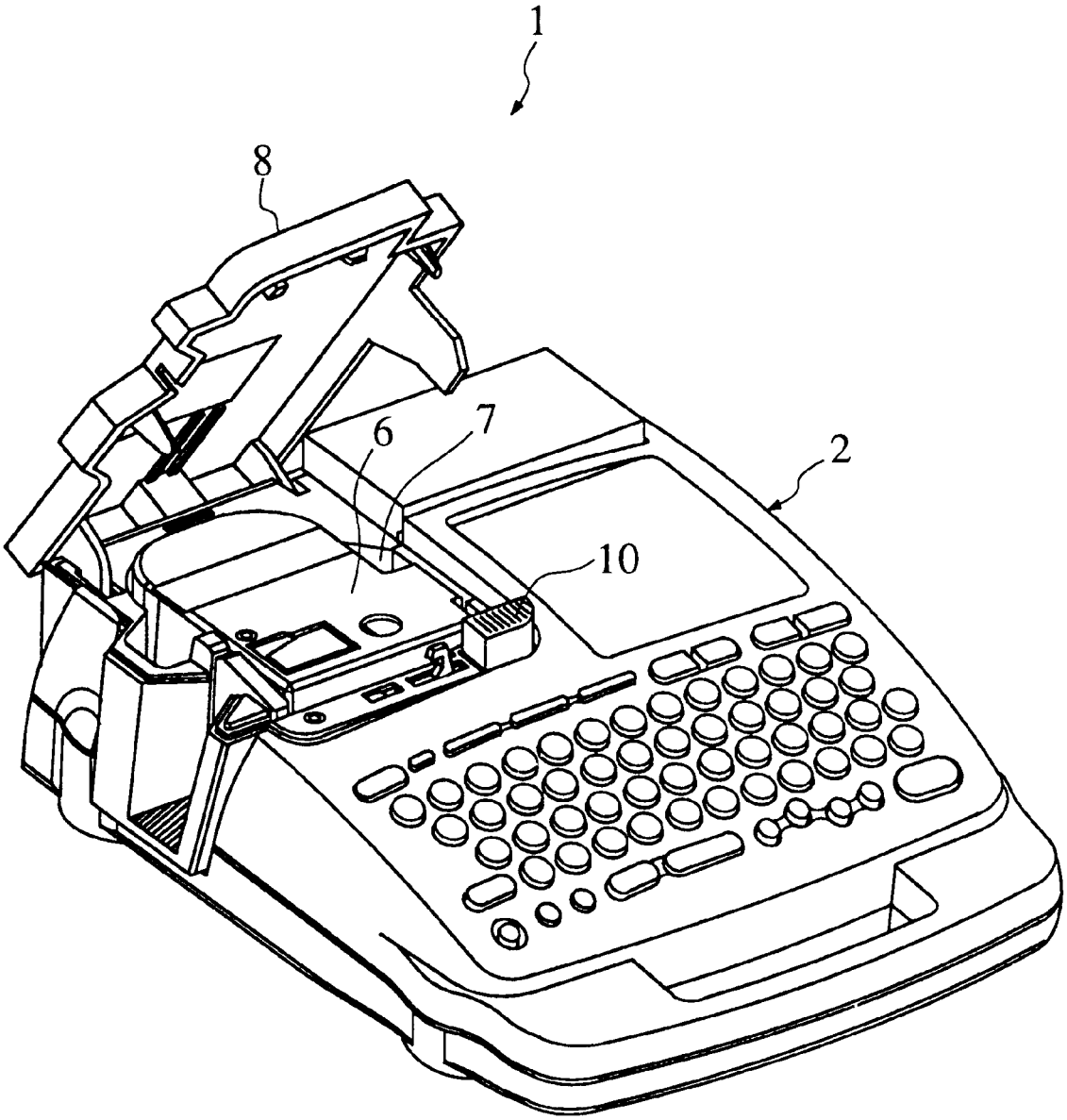
FIG. 16 is a perspective view of the tape printing apparatus with its lid half-open.

When the printing is completed and the cartridge 6 is taken out of the pocket 6, first, the release button 1 is depressed to bring the lid 8 to the half-open position (the state shown in FIG. 16). Then, the lid 8 is manually opened to the fully-open position to elevate the cartridge 6 to the elevated position in the manner described above (the state shown in FIG. 14). Then, after removing the cartridge 6, the lid 6 is fully closed (the state shown in FIG. 1).

Thus, according to the present embodiment, when the cartridge 6 is in a properly loaded or printable position, the lid 8 can be brought to the half-open position. This makes it possible to ascertain the seal 33 on the cartridge 6 when the cartridge 6 is loaded in the pocket 7. Further, from the half-open position, the lid 8 can be closed again to restore the printable or standby state for printing or otherwise the lid 8 can be fully-opened for prompt replacement of the cartridge 6. Therefore, ascertaining of the seal is made less troublesome, and the apparatus can be set to a printing mode promptly. In particular, the ascertaining of the seal 33 tends to be carried out after entering characters and before printing. Therefore, the present embodiment reduces the possibility of erroneous operations during the ascertaining of the seal or width of the tape T, and time required for ascertaining the seal before starting the printing.

Figure 17:
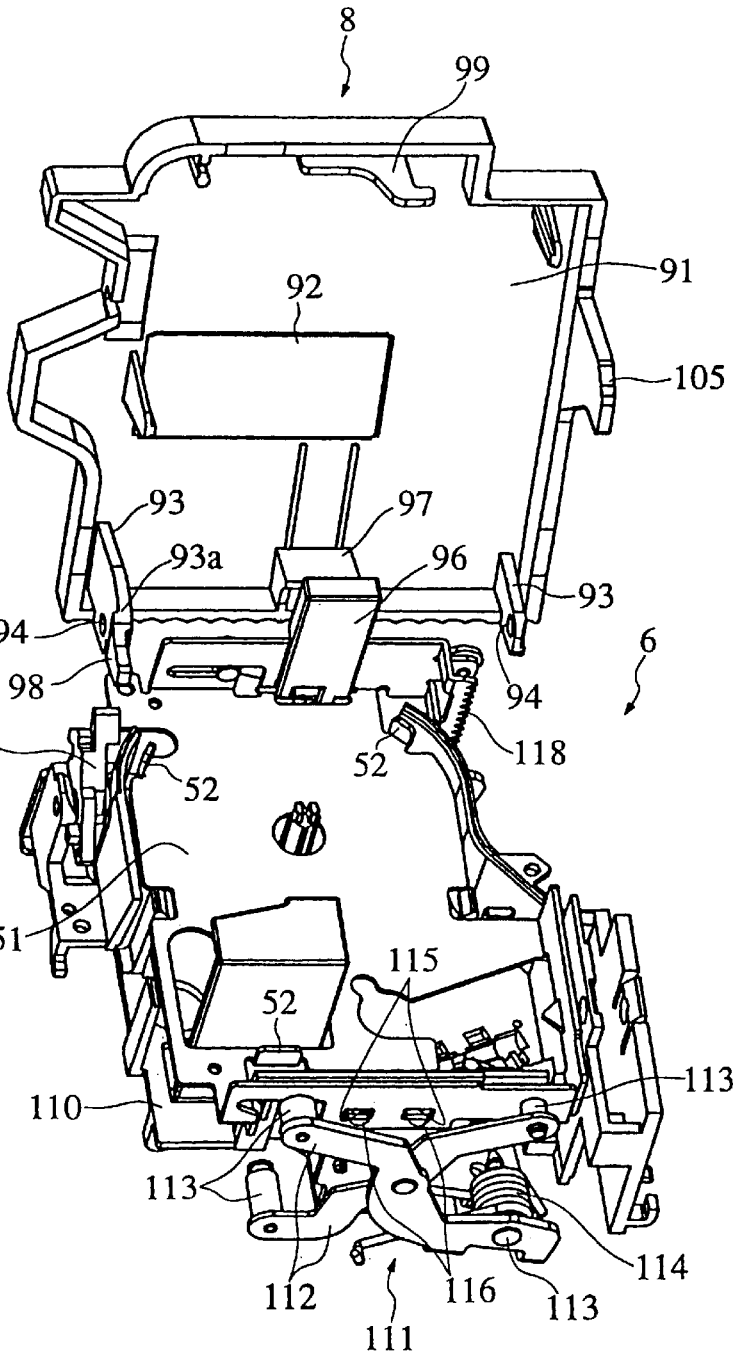
FIGS. 17 and 17A is a perspective view showing the lid, an ejecting mechanism, and component parts associated with the ejecting mechanism.
Figure 17A:
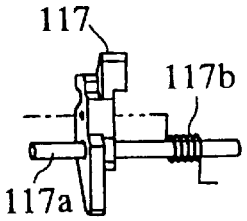
Figure 18:
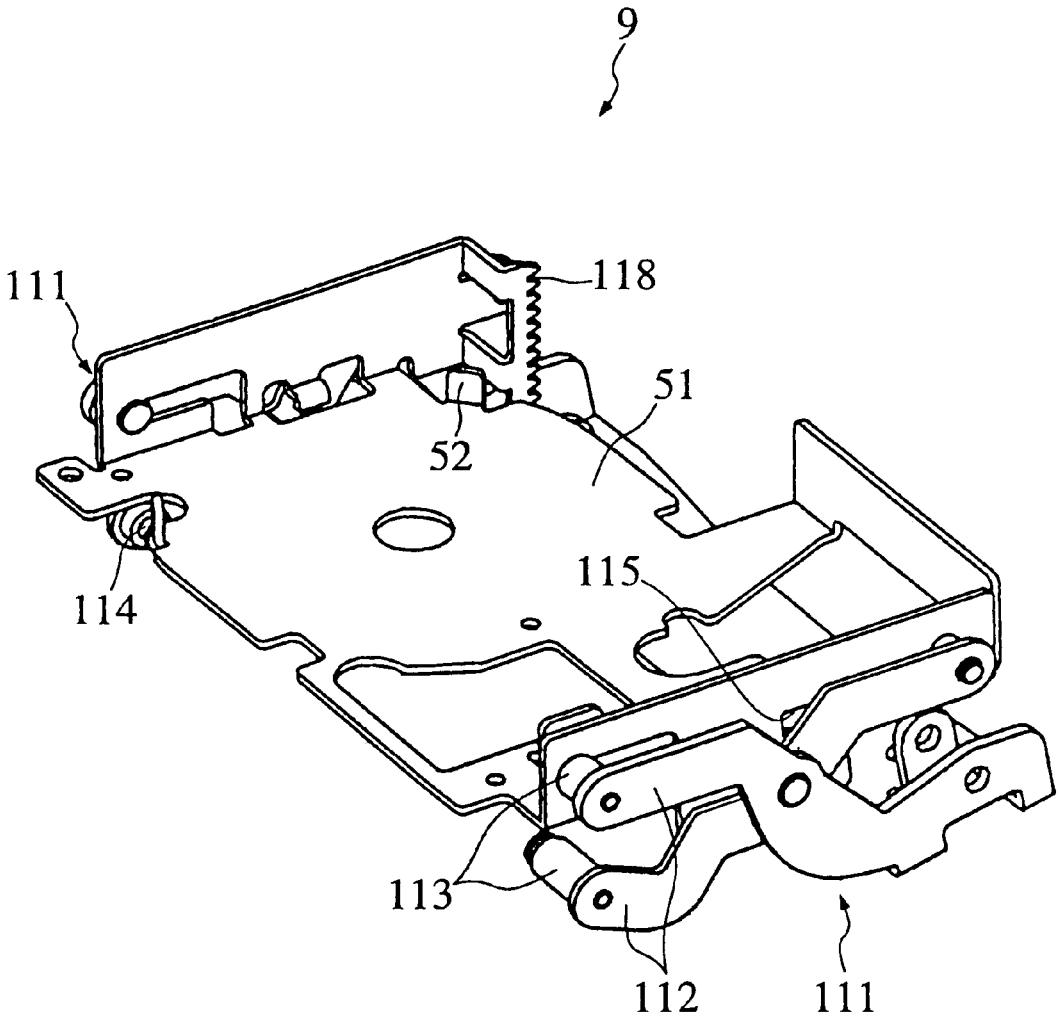
FIG. 18 is a perspective view showing essential parts of the ejecting mechanism as viewed from a front side.
Figure 19:
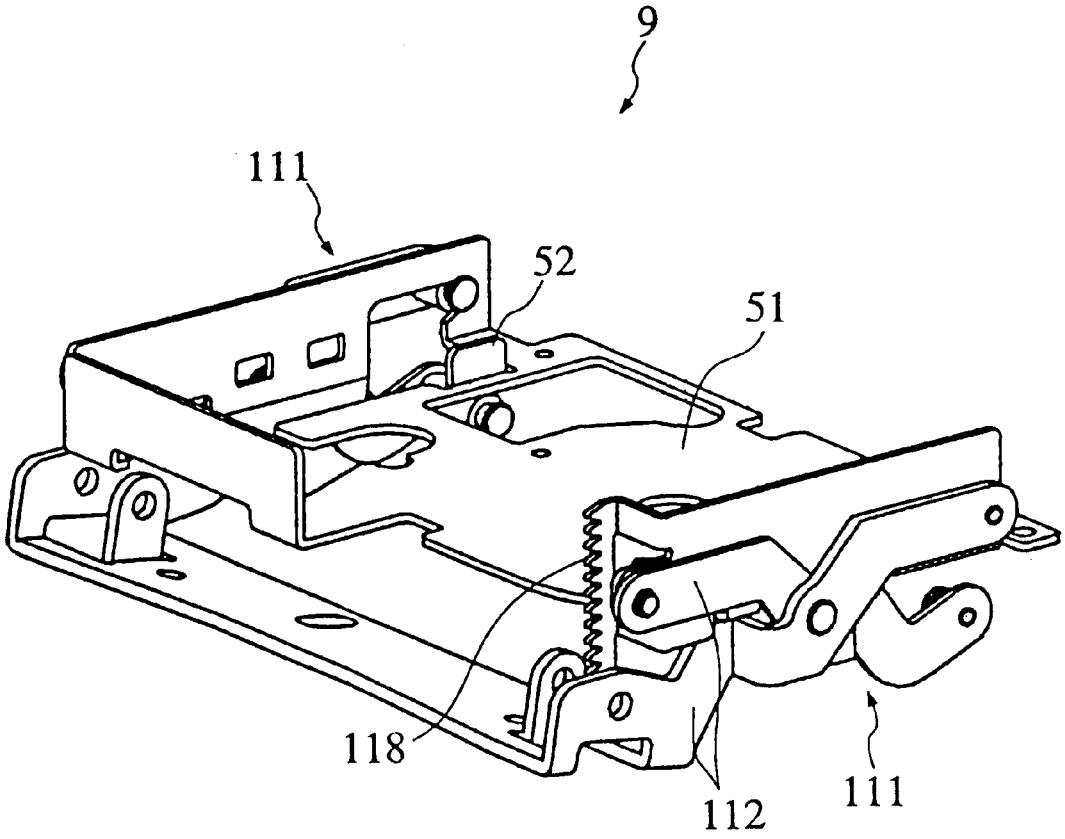
FIG. 19 is a perspective view showing essential parts of the ejecting mechanism as viewed from a rear side.

Then, referring to FIGS. 17, 18, and 19, the description will be made of the ejecting mechanism 9. As shown in these figures, the ejecting mechanism 9 is comprised of a fixed plate 110 fixed on the body 2, the base plate 51 arranged on the upper side of the fixed plate 110, a pair of X-shaped links 111, 111 arranged on the front side and the rear side of the base plate 51 for supporting the base plate 51 in a vertically movable fashion for vertical translation of the base plate 51.

Each X-shaped link 111 is comprised of two link bars 112 having respective intermediate portions rotatably connected to each other. The link bars 112 have respective one ends rotatably and horizontally slidably connected to the fixed plate 110 and the base plate 51 by pins 113, 113, respectively, and respective other ends rotatably connected to the fixed plate 110 and the base plate 51 by pins 113, 113, the lower one of which has a torsion coil spring 114 wound therearound. The torsion coil spring 114 urges the X-shaped links 111 in a closing direction, in other words, in a direction elevating the base plate 51.

On the other hand, an upward bent portion of a front end of the base plate 51 to which the X-shaped link is attached is formed with rectangular through holes 115, 115, into which locking nails 116 are retractably inserted. The locking nails 116 are linked to a font end of an operating link, not shown, arranged under the fixed plate 110, and a rear end of the operating link 110 is connected to an operating bar 117 which is opposed to the hinge piece 93 on the left side. The operating bar 117 is rotatably connected to the fixed plate 110 by way of a shaft 117*a*, and urged in both directions by the spring 117*b* wound around the shaft 117*a*, not shown, with a position in which the operating bar 117 is oriented obliquely backward as a neutral position.

When the lid 8 is in the fully-closed position, a curved portion 93*a* at the front side of the hinge 93 is in contact with the upper side of the operating bar 117 whereby the lid 8 is slightly urged in an opening direction by the urging force of the spring 117*b*. When the lid 8 is in the half-open position, the operating bar 117 is in the neutral position, thereby holding the lid 8 in the half-open position with a slight force. If the lid 8 is further rotated in the opening direction, the curved portion 93*a* of the hinge piece 93 is moved away from the operating bar 117, and instead, the extended portion 98 is rotated into the underside of the operating bar 117, thereby rotating the operating bar 117 toward its upright position (forward) against the urging force of the spring 117*b*. When the operating bar 117 is rotated forward, the locking nails 116 are disengaged from the rectangular through holes 115 by the operation of the operating link, to unlock the base plate 51, whereupon the base plate 51 starts to be elevated by the force of the torsion coil spring 114.

When the operating bar 117 is rotated further forward, the extended portion 98 of the hinge piece 93 is disengaged from the operating bar 117, whereby the operating bar 117 returns to its neutral position, and the lid 8 is in its fully free position. The lowermost position of the base plate 51 is a position where the locking nails 116 are engaged with the rectangular through holes 115, and the uppermost position is a position where the pins 113 on the sliding side of the X-shaped links 111 are in the limit position of outward sliding thereof. Further, reference numeral 118 in FIG. 17 represents a toothed portion formed on the base plate 51 which mates with a braking gear, not shown, for braking the upward movement of the base plate 51. That is, the base plate 51 slowly moves upward after it is liberated from its locked state.

Figure 20:
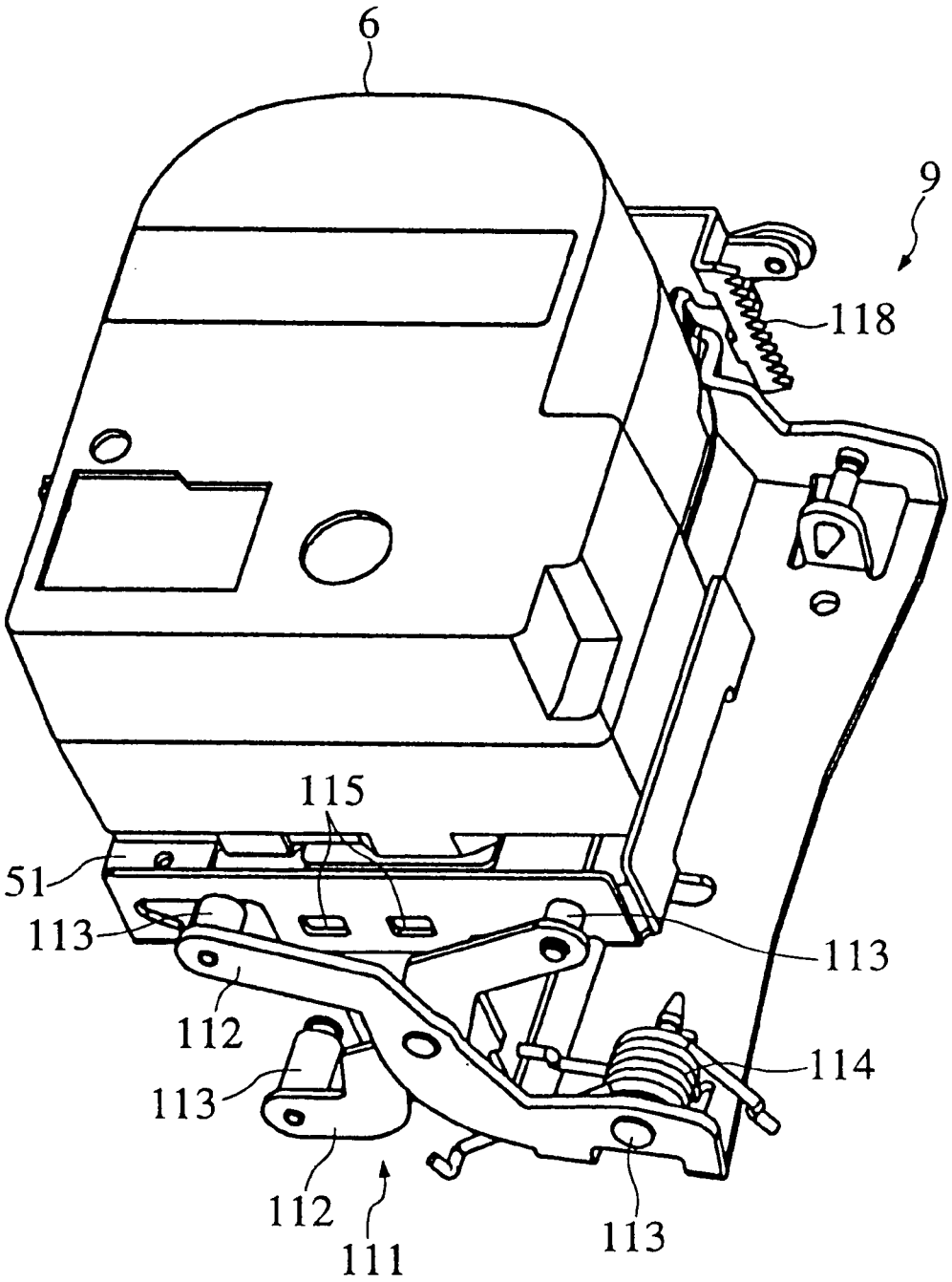
FIG. 20 is a perspective view of the ejecting mechanism and the cartridge in an elevated position.
Figure 21:
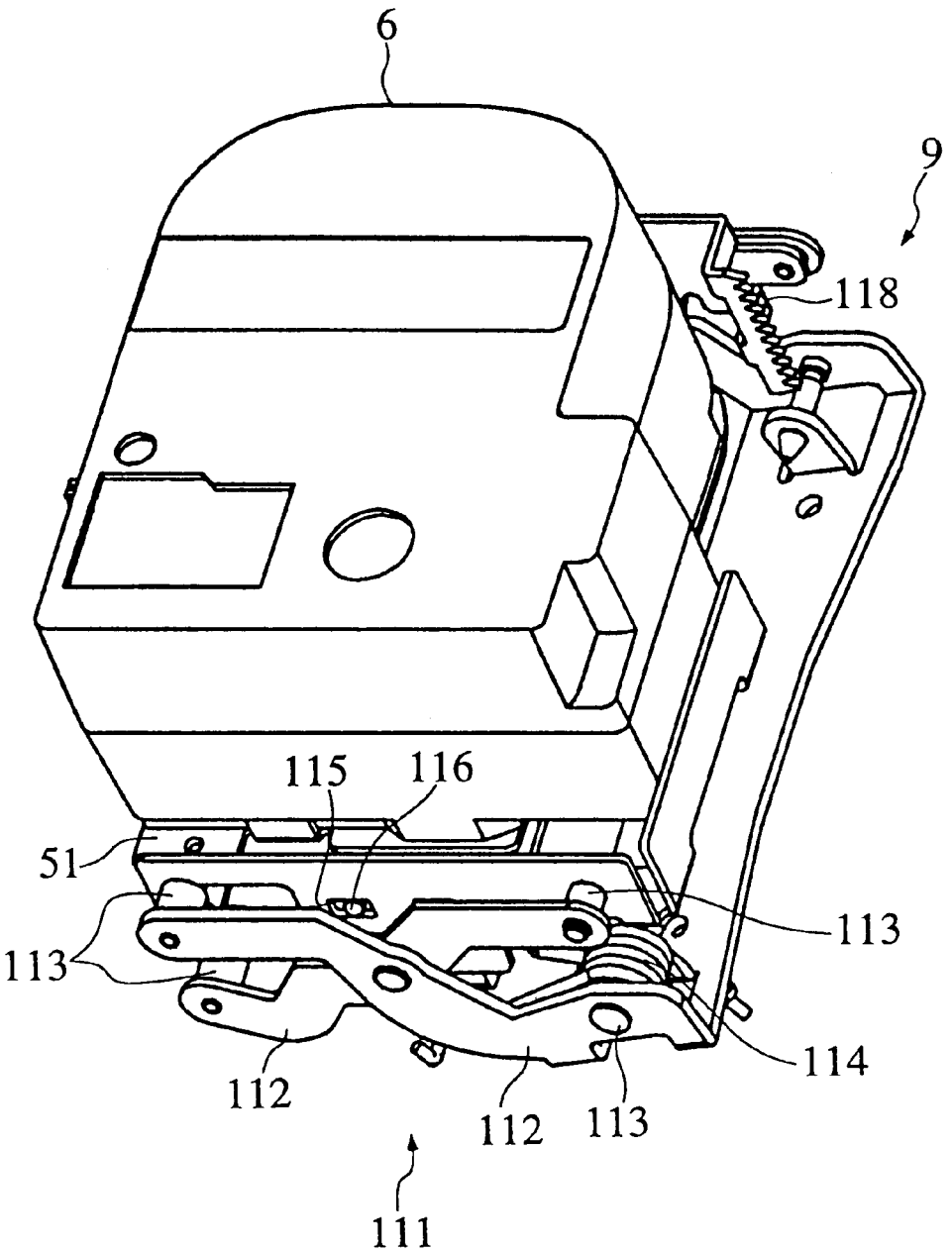
FIG. 21 is a perspective view of the ejecting mechanism and the cartridge in a lowered position.

Next, the operation of the ejecting mechanism 9 will be described briefly with reference to FIGS. 20 and 21. FIG. 21 shows a state of the ejecting mechanism 9 which corresponds to FIG. 14. The X-shaped links 111 are each in the closed state. From this state, when the cartridge 6 is pressed downward, the X-shaped links 111 are moved into respective open states until the base plate 51 is in its lowermost position, whereupon the locking nails 116 are engaged with the rectangular through holes 115 to lock the base plate 51 and places the cartridge 6 in the fully-loaded position (see FIGS. 21 and 15). On the other hand, when the lid 8 is rotated in the opening direction from its half-open position (i.e. manually opened), the locking nails 116 are disengaged from the rectangular through holes 115 (unlocking of the base plate 51), so that the X-shaped links 111 are moved into the closed states until the base plate 51 is brought to its upper most position (see FIG. 20).

Thus, a manual operation of rotating the lid 8 in the opening direction from the half-open position is used as a trigger to start the ejecting operation of the ejecting mechanism 9. Therefore, the ejecting mechanism can be operated without any sense of disorder. Further, the ejecting mechanism 9 is returned to its lowermost position by pressing the cartridge 6 into the pocket 7. This requires no provision of a drive source therefor, and hence the construction of the ejecting mechanism 9 can be simplified. Moreover, the user's manual operation of pressing the cartridge 6 into the pocket 7 makes the user assured of the proper loading of the cartridge 6.

Still further, it goes without saying that the invention can be applied to various kinds of tape printing apparatuses which employ a plurality of kinds of tape cartridges different in height.

It is further understood by those skilled in the art that the foregoing are preferred embodiments of the invention, and that various changes and modification may be made without departing from the spirit and scope thereof.

What is claimed is:

1. A tape printing apparatus comprising:

a cartridge containing a tape-like member as a printing object material;

a body having a pocket formed therein for removably loading said cartridge;

a lid arranged on said body for opening and closing the pocket in a hinged-door form, the lid defining at least a fully-closed position in which the lid fully closes said pocket, a fully-open position in which the lid opens to a generally upright position so as to prevent the lid from obstructing the cartridge when the cartridge is loaded in the pocket, and a half-open position therebetween; and an ejecting mechanism for elevating said cartridge when said cartridge is in a state loaded in said pocket, wherein the ejecting mechanism includes opening means for opening the lid from the fully-closed position to the half-open position without elevating the cartridge and interlocking means for elevating the cartridge only in association with a manual opening operation to open the lid from the half-open position to the fully-open position.

2. A tape printing apparatus according to claim 1, wherein the pocket has a bottom surface, and the ejecting mechanism transfers said cartridge upwardly and in parallel with the bottom surface of the pocket.

3. A tape printing apparatus comprising:

a cartridge containing a tape-like member as a printing object material;

a body having a pocket formed therein for removably loading said cartridge;

a lid arranged on said body for opening and closing the pocket in a hinged-door form, the lid defining at least a fully-closed position in which the lid fully closes said pocket, a fully-open position in which the lid opens to a generally upright position so as to prevent the lid from obstructing the cartridge when the cartridge is loaded in the pocket, and a half-open position therebetween;

an ejecting mechanism for elevating said cartridge when said cartridge is in a state loaded in said pocket, wherein the ejecting mechanism includes interlocking means for elevating the cartridge only in association with a manual opening operation to open the lid from the half-open position to the fully-open position; and a spring member for causing said lid to be pivotally moved from the fully-closed position to the half-open position; and release operation means for holding said lid in a hooked state, and releasing said lid from said hooked state.

4. A tape printing apparatus comprising:

a cartridge containing a tape-like member as a printing object material;

a body having a pocket formed therein for removably loading said cartridge;

a lid arranged on said body for opening and closing the pocket in a hinged-door form, the lid defining at least a fully-closed position in which the lid fully closes said pocket, a fully-open position in which the lid opens to a generally upright position, and a half-open position therebetween; and an ejecting mechanism for elevating said cartridge when said cartridge is in a state loaded in said pocket, wherein said ejecting mechanism comprises a base plate arranged vertically movable for receiving said cartridge thereon, urging means for urging said base plate in an elevating direction, and plate-locking means for locking said base plate in a lowermost position and unlocking said base plate in a fashion interlocked to an opening operation of said lid.

5. A tape printing apparatus comprising:

a cartridge containing a tape-like member as a printing object material;

a body having a pocket formed therein for removably loading said cartridge;

a lid arranged on said body for opening and closing the pocket in a hinged-door form, the lid defining at least a fully-closed position in which the lid fully closes said pocket, a fully-open position in which the lid opens to a generally upright position so as to prevent the lid from obstructing the cartridge when the cartridge is loaded in the pocket, and a half-open position therebetween; and an ejecting mechanism for elevating said cartridge when said cartridge is in a state loaded in said pocket, wherein the ejecting mechanism includes interlocking means for elevating the cartridge only in association with a manual opening operation to open the lid from the half-open position to the fully-open position;

wherein said ejecting mechanism comprises a base plate arranged vertically movable for receiving said cartridge thereon, urging means for urging said base plate in an elevating direction, and plate-locking means for locking said base plate in a lowermost position and unlocking said base plate in a fashion interlocked to a opening operation of said lid.

6. A tape printing apparatus according to claim 5, wherein said pocket receives one of a large-height cartridge and a small-height cartridge, said base plate comprising a base plate body for receiving said large-height cartridge thereon, and projections extending upward from said base plate body for receiving said small-height cartridge thereon.

7. A tape printing apparatus comprising:

a cartridge containing a tape-like member as a printing object material;

a body having a pocket formed therein for removably loading said cartridge;

a lid arranged on said body for opening and closing the pocket in a hinged-door form, the lid defining at least a fully-closed position in which the lid fully closes said pocket, a fully-open position in which the lid opens to a generally upright position so as to prevent the lid from obstructing the cartridge when the cartridge is loaded in the pocket, and a half-open position therebetween; and an ejecting mechanism for elevating said cartridge when said cartridge is in a state loaded in said pocket, wherein the ejecting mechanism includes interlocking means for elevating the cartridge only in association with a manual opening operation to open the lid from the half-open position to the fully-open position;

wherein said lid has a hinge portion via which said lid is pivotally and detachably mounted on said body, said tape printing apparatus including closing obstruction means for obstructing a closing operation of said lid when said cartridge is in an elevated position in said pocket.

8. A tape printing apparatus according to claim 7, wherein said closing obstruction means has an obstruction member for being brought into a position for obstructing said closing operation of said lid in a manner interlocked to elevation of said cartridge in said pocket, said obstructing member being held in said position for obstructing said closing operation of said lid through abutment on said cartridge in said elevated position.

9. In a tape printing apparatus comprising a cartridge containing a tape-like member for use in printing, a body having a pocket formed therein for removably loading the cartridge, said pocket defining an opening, a shallow position and a deep position deeper than said shallow position with respect to the opening, said cartridge comprising at least one of a small-height cartridge containing a tape-like member having a small width, said small-height cartridge having a seating portion, and a large-height cartridge containing a tape-like member having a large width, said large-height cartridge having a seating portion, and a base plate being arranged on the pocket for receiving the cartridge, the base plate including a support projection formed by cutting a peripheral portion of the base plate and upwardly bending the cut peripheral portion;

the improvement wherein the upper surface of the base plate receives the seating portion of the large-height cartridge in the deep position in the pocket, and the support projection receives the seating portion of the small-height cartridge in the shallow position in the pocket, said support projection being arranged in a position away from said seating portion of said large-height cartridge when said large-height cartridge is loaded in said pocket;

said upper surface of the base plate being arranged in a position away from said seating portion of said small-height cartridge when said small-height cartridge is loaded in said pocket.

10. In a tape printing apparatus comprising a cartridge containing a tape-like member for use in printing, a body having a pocket formed therein for removably loading the cartridge, said pocket defining an opening, a shallow position and a deep position deeper than said shallow position with respect to the opening, said cartridge comprising at least one of a small-height cartridge containing a tape-like member having a small width, said small-height cartridge having a seating portion, and a large-height cartridge containing a tape-like member having a large width, said large-height cartridge having a seating portion, the improvement wherein said body has first support means arranged in said pocket for receiving said seating portion of said small-height cartridge in said shallow position in said pocket and second support means arranged in said pocket for receiving said seating portion of said large-height cartridge in said deep position in said pocket;

said first support means being arranged in a position away from said seating portion of said large-height cartridge when said large-height cartridge is loaded in said pocket;

said second support means being arranged in a position away from said seating portion of said small-height cartridge when said small-height cartridge is loaded in said pocket;

wherein said cartridge has a tape reel, said tape-like member being contained within said cartridge in a state wound around said tape reel, said small-height cartridge having a first detent member for inhibiting said tape reel from rotation, and said large-height cartridge having a second detent member for inhibiting said tape reel from rotation, said body having a first release member for releasing said tape reel from said first detent member, and a second release member for releasing said tape reel from said second detent member, said first release member being capable of retracting from said pocket, said second release member being arranged at a location in which said second release member is away from said small-height cartridge when said small-height cartridge is loaded in said pocket, said large-height cartridge being formed with an urging portion for causing said first release member to be retracted from said pocket as said large-height cartridge is loaded in said pocket.

11. In a tape printing apparatus comprising a cartridge containing a tape-like member for use in printing, a body having a pocket formed therein for removably loading the cartridge, said pocket defining an opening a shallow position and a deep position deeper than said shallow position with respect to the opening, said cartridge comprising at least one of a small-height cartridge containing a tape-like member having a small width, said small-height cartridge having a seating portion, and a large-height cartridge containing a tape-like member having a large width, said large-height cartridge having a seating portion, the improvement wherein said body has first support means arranged in said pocket for receiving said seating portion of said small-height cartridge in said shallow position in said pocket and second support means arranged in said pocket for receiving said seating portion of said large-height cartridge in said deep position in said pocket;

said first support means being arranged in a position away from said seating portion of said large-height cartridge when said large-height cartridge is loaded in said pocket;

said second support means being arranged in a position away from said seating portion of said small-height cartridge when said small-height cartridge is loaded in said pocket; and a drive source;

wherein said cartridge contains a rotating member for feeding said tape-like member, said rotating member having a shaft hole formed therein, said body having a drive shaft for being engaged in said shaft hole of said rotating member, said drive shaft having a drive shaft body for engagement with said shaft hole, said drive shaft body being connected to said drive source, a center pin for supporting said drive shaft body in a rotatable and axially movable fashion, and a spring for urging said drive shaft body toward said cartridge.

12. In a tape printing apparatus cartridge containing a tape-like member for use in printing, a body having a pocket formed therein for removably loading the cartridge, said pocket defining an opening, a shallow position and a deep position deeper than said shallow position with respect to the opening, said cartridge comprising at least one of a small-height cartridge containing a tape-like member having a small width, said small-height cartridge having a seating portion, and a large-height cartridge containing a tape-like member having a large width, said large-height cartridge having a seating portion, the improvement wherein said body has first support means arranged in said pocket for receiving said seating portion of said small-height cartridge in said shallow position in said pocket and second support means arranged in said pocket for receiving said seating portion of said large-height cartridge in said deep position in said pocket;

said first support means being arranged in a position away from said seating portion of said large-height cartridge when said large-height cartridge is loaded in said pocket;

said second support means being arranged in a position away from said seating portion of said small-height cartridge when said small-height cartridge is loaded in said pocket;

wherein said cartridge includes a tape reel around which said tape-like member is wound, and a detent member for restricting rotation of said tape reel, said body having a release projection which extends into said pocket for urging said detent member into a release position, said release projection having a first urging member for urging said detent member of said small-height cartridge and a second urging member for urging said detent member of said large-height cartridge, said first urging member being arranged at a location in which said first urging member is away from said detent member of said large-height cartridge when said large-height cartridge is loaded in said pocket, said second urging member being arranged at a location in which said second urging member is away from said detent member of said small-height cartridge when said small-height cartridge is loaded in said pocket.

13. A tape printing apparatus according to claim 9, wherein the base plate rises and falls in accordance with ejection of and loading of the tape cartridge, respectively.

14. An ejecting mechanism for ejecting a tape cartridge comprising:

a tape cartridge;

a main body having a pocket for removably receiving the tape cartridge and a lid for opening and closing the pocket, the lid being movable in a hinged-fashion between a fully-closed position in which the lid fully closes the pocket and a fully-open position in which the lid opens to fully expose the pocket, wherein a half-open position is defined between the fully-closed position and the fully-open position; and release button means for opening the lid covering the pocket of the main body, wherein the lid is opened up to the half-open position by pushing the release button means, and wherein the tape cartridge loaded in the pocket is elevated by opening up the lid from the half-open position to the fully-open position so that the tape cartridge can be removed from the pocket when the lid is opened up to the fully-open position.

15. The ejecting mechanism according to claim 14, including elevating means for moving the tape cartridge between a highermost position at the fully-open position of the lid and a lowermost position at the fully-closed position of the lid, wherein the elevating means automatically lowers the tape cartridge to the lowermost position by loading the tape cartridge in the pocket.

16. A method of ejecting a tape cartridge from a tape printing apparatus, the tape printing apparatus including a tape cartridge, a main body having a pocket for removably receiving the tape cartridge and a lid for opening and closing the pocket, the lid being movable between a fully-closed position in which the lid fully closes the pocket and a fully-open position in which the lid opens to fully expose the pocket, wherein a half-open position is defined between the fully-closed position and the fully-open position, the method comprising the steps of:

(a) opening the lid covering the pocket in which the tape cartridge is loaded to the halfopen position by pushing a release button;

(b) opening the lid up to the fully-open position;

(c) elevating the tape cartridge in association with the step of (b); and (d) ejecting the tape cartridge thus elevated.

17. A tape printing apparatus comprising:

a body having a pocket formed therein;

a cartridge loading section disposed in said pocket;

a lid arranged on said body in a hinged-door form, wherein said lid defines at least a fully-closed position in which said lid fully closes said pocket, a fully-open position in which said lid opens with respect to said pocket, and a half-open position therebetween;

ejecting mechanism means for allowing the lid to open from the filly-closed position to the half-closed position without elevating the cartridge loading section and for elevating the cartridge loading section in association with an opening operation to open the lid from the halfopen position to the fully-open position.

18. A tape printing apparatus according to claim 17, wherein the lid is in a generally upright position when the lid opens to the fully-open position.

19. A tape printing apparatus according to claim 18, wherein the pocket has a bottom surface, and the ejecting mechanism means transfers said cartridge upwardly and in parallel with the bottom surface of the pocket.

* * * * *